US008532542B2

(12) United States Patent
Mitsuishi et al.

(10) Patent No.: US 8,532,542 B2
(45) Date of Patent: Sep. 10, 2013

(54) TONER CONTAINER AND MANUFACTURING METHOD FOR TONER CONTAINER

(75) Inventors: Kaori Mitsuishi, Susono (JP); Seiji Terazawa, Mishima (JP); Atsushi Inoue, Numazu (JP); Tomoji Ishikawa, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 251 days.

(21) Appl. No.: 12/842,680

(22) Filed: Jul. 23, 2010

(65) Prior Publication Data

US 2011/0020039 A1 Jan. 27, 2011

(30) Foreign Application Priority Data

Jul. 23, 2009 (JP) ..... 2009-172494
Jul. 23, 2009 (JP) ..... 2009-172527

(51) Int. Cl.
*G03G 15/08* (2006.01)

(52) U.S. Cl.
USPC ..... 399/262; 399/106; 399/111; 399/120; 399/258

(58) Field of Classification Search
USPC ..... 399/12, 111, 262; 222/DIG. 1
See application file for complete search history.

(56) References Cited

U.S. PATENT DOCUMENTS 5,870,652 A * 2/1999 Kanamori et al. ..... 399/106
5,966,574 A * 10/1999 Ui et al. ..... 399/258
6,173,130 B1 * 1/2001 Oguma ..... 399/27
6,259,877 B1 * 7/2001 Taniyama et al. ..... 399/262
6,298,208 B1 * 10/2001 Kawamura et al. ..... 399/262
7,203,449 B2 * 4/2007 Ban et al. ..... 399/258
7,221,891 B2 5/2007 Matsumoto et al.
7,447,469 B2 11/2008 Uchiyama et al.
7,577,385 B2 * 8/2009 Ban et al. ..... 399/258
7,616,905 B2 11/2009 Masubuchi
7,653,327 B2 * 1/2010 Kimura et al. ..... 399/120
7,711,293 B2 * 5/2010 Koyama ..... 399/262
7,761,039 B2 * 7/2010 Nishimura et al. ..... 399/262
7,792,468 B2 * 9/2010 Ichikawa et al. ..... 399/262
7,792,469 B2 * 9/2010 Ichikawa et al. ..... 399/262
7,805,092 B2 * 9/2010 Mihara ..... 399/106
7,983,592 B2 * 7/2011 Naito et al. ..... 399/106
8,027,596 B2 * 9/2011 Ohyama et al. ..... 399/12

(Continued)

FOREIGN PATENT DOCUMENTS

JP 2004-85812 3/2004
JP 2010-79118 4/2010
WO WO 2010/029826 A1 3/2010

*Primary Examiner* — David Gray
*Assistant Examiner* — Francis Gray
(74) *Attorney, Agent, or Firm* — Oblon, Spivak, McClelland, Maier & Neustadt, L.L.P.

(57) ABSTRACT

A toner container includes a cylindrical container body, having a first opening in a first end thereof and a notch in a circumferential surface thereof continuous with the first opening in the first end, a flange member to engage the first opening and the notch in the container body and having a toner outlet therein through which toner in the container body is discharged, a shutter member disposed on the outer circumferential surface of the container body, a conveyance member, rotatably installed inside the container body to convey the toner from a second end of the container body opposite the first end to the toner outlet in the flange member, and a recessed portion in the container body that projects inward into the interior of the toner container 5 mm or less from an inner surface of the container body.

41 Claims, 19 Drawing Sheets

(56) References Cited

U.S. PATENT DOCUMENTS

| | | | | |
|---|---|---|---|---|
| 8,290,378 | B2 * | 10/2012 | Ohyama et al. | 399/12 |
| 2003/0049052 | A1 * | 3/2003 | Wang et al. | 399/262 |
| 2003/0219263 | A1 * | 11/2003 | Tsuzuki | 399/27 |
| 2006/0147228 | A1 * | 7/2006 | Nagahama et al. | 399/262 |
| 2007/0147902 | A1 | 6/2007 | Taguchi et al. | |
| 2007/0231016 | A1 * | 10/2007 | Ban et al. | 399/258 |
| 2008/0124133 | A1 | 5/2008 | Yoshizawa et al. | |
| 2008/0260432 | A1 * | 10/2008 | Ohyama et al. | 399/258 |
| 2009/0087198 | A1 * | 4/2009 | Okamura | 399/12 |
| 2010/0119264 | A1 | 5/2010 | Yamaguchi et al. | |

* cited by examiner

FIG. 16-A1
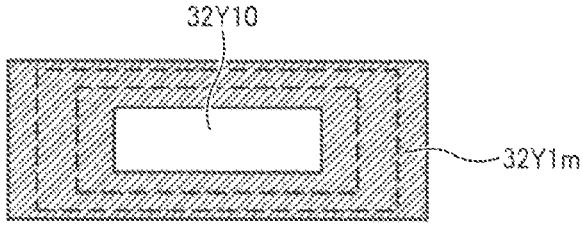
FIG. 16-A2
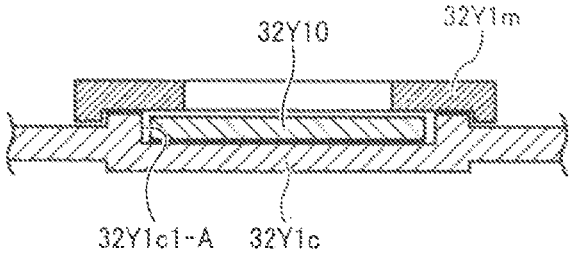
FIG. 16-B1
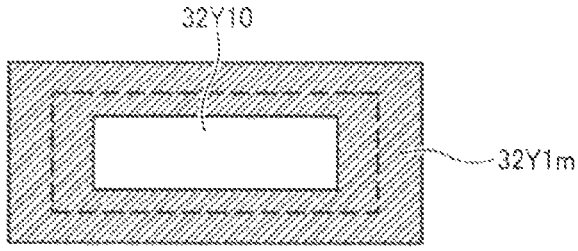
FIG. 16-B2
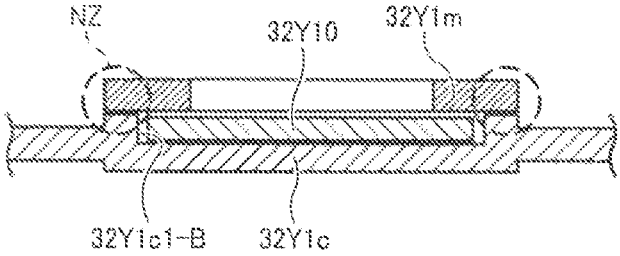
FIG. 16-C1
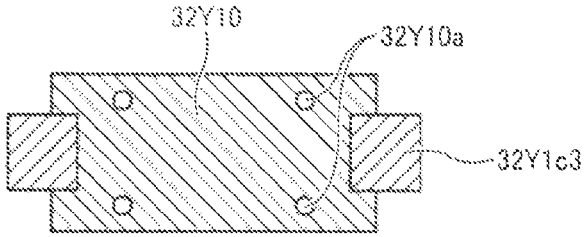
FIG. 16-C2
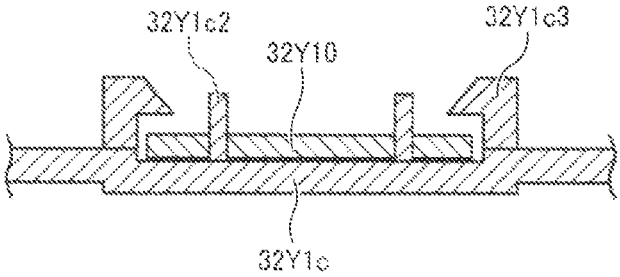

FIG. 16-D1
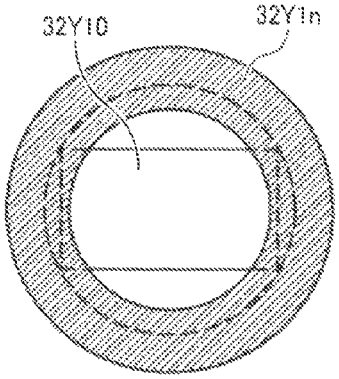
FIG. 16-E1
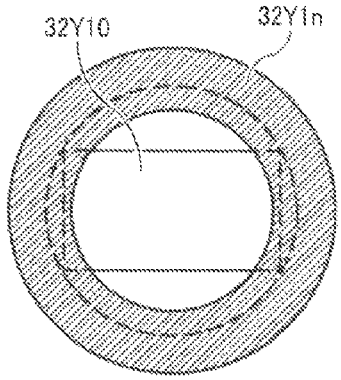
FIG. 16-D2
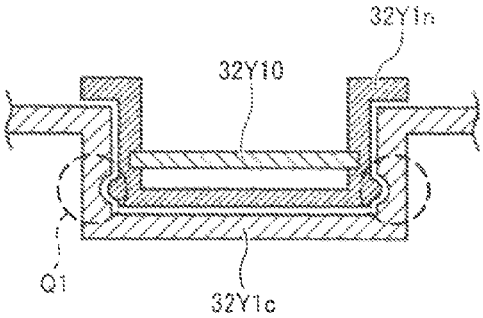
FIG. 16-E2
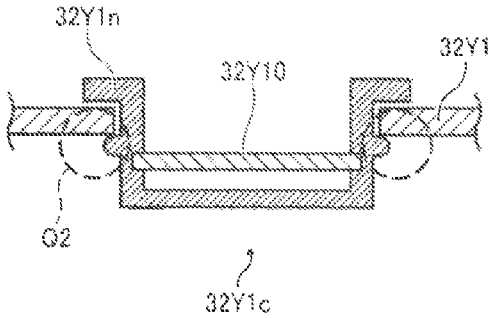
FIG. 17A
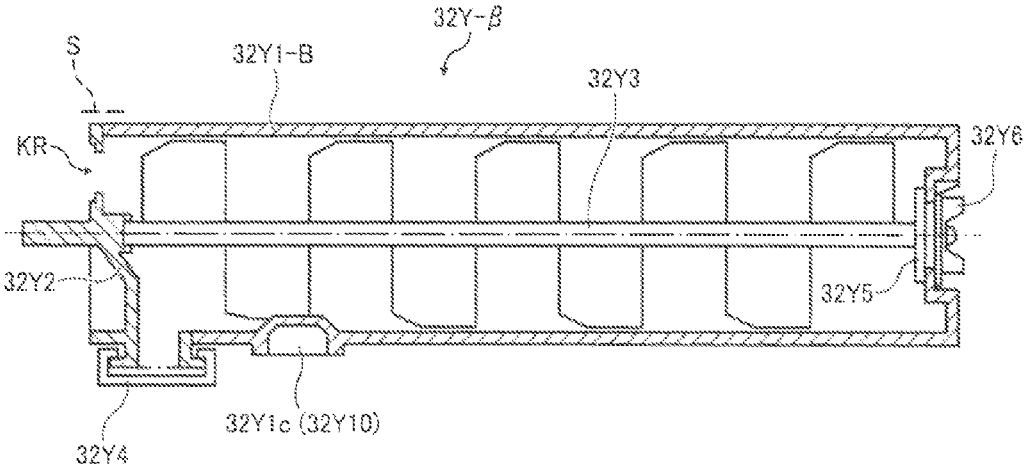

FIG. 17B
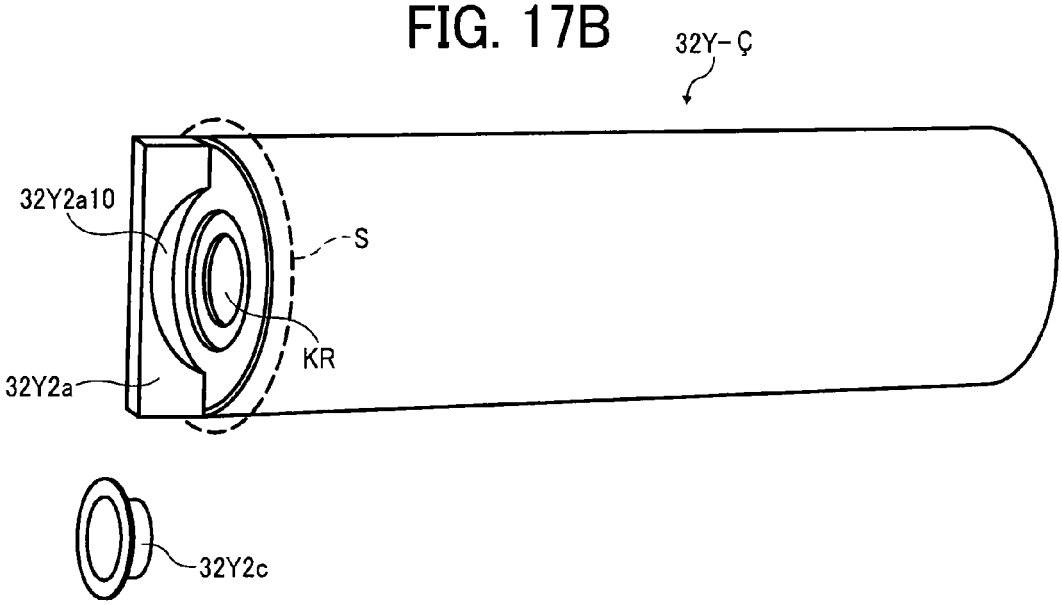
FIG. 18-A1
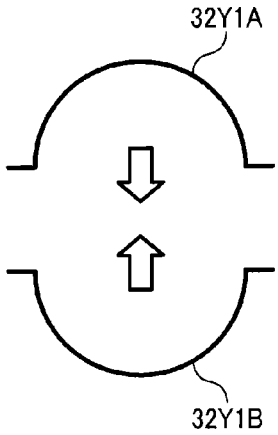
FIG. 18-A2
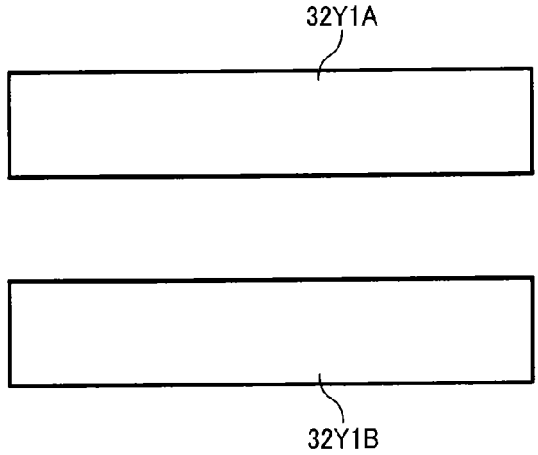
FIG. 18-B1
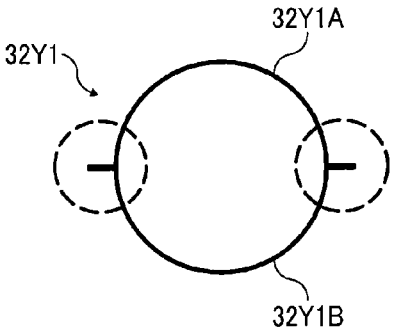
FIG. 18-B2
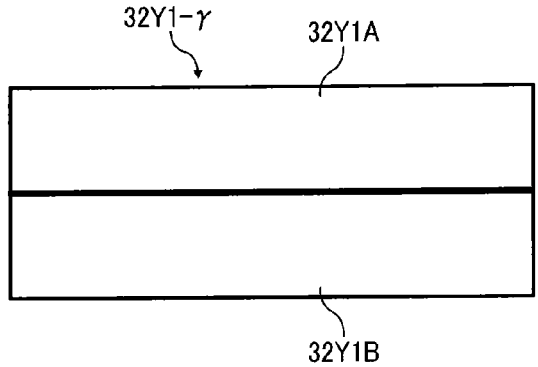

TONER CONTAINER AND MANUFACTURING METHOD FOR TONER CONTAINER

CROSS-REFERENCE TO RELATED APPLICATIONS

This patent specification claims priority from Japanese Patent Application Nos. 2009-172494, filed on Jul. 23, 2009 and 2009-172527, filed on Jul. 23, 2009 in the Japan Patent Office, the contents of which are hereby incorporated by reference herein in their entirety.

Additionally, this patent specification is based on U.S. patent application Ser. No. 12/682,895, filed on Nov. 27, 2009 in the United States Patent and Trademark Office, the contents of which are hereby incorporated by reference herein in their entirety.

BACKGROUND OF THE INVENTION

1. Field of the Invention

The present invention relates to a toner container included in an image forming apparatus such as a copier, a printer, a facsimile machine, a plotter, and a multi-function machine, and manufacturing method of the toner container.

2. Discussion of the Background

Electrophotographic image forming apparatuses such as copiers, printers, facsimile machines, plotters, multi-function machines, or the like typically include toner containers. In general, cylindrical toner containers (bottles) that are removably installable in the image forming apparatuses are used.

In JP-2004-85812-A and US-2007-0147902-A, a toner container (toner cartridge) that is removably installable in the image forming apparatus includes a conveyance member, such as an agitator, a screw, or a coil. The conveyance member receives a driving force from the image forming apparatus and rotates in a predetermined direction, to convey the toner in a longitudinal direction in the toner container to a toner outlet formed on one side of the toner container.

In a further refinement, in US-2007-0147902-A, an electronic data storage such as an identification chip (ID) set in the toner container stores various types of data, such as the type of toner and the production lot number of the toner. The electronic data storage in the toner container and a communication circuit in the image forming apparatus can exchange data.

Such toner containers installable in the image forming apparatus are typically replaceable, with a certain amount of used toner container recycled. However, when the above-described toner container is recycled, because the electronic data storage is fixedly mounted on the toner container by gluing or thermal welding, it takes a great deal of time and effort to separate the electronic data storage from the toner container.

More specifically, when a container body of the toner container is reused, the residual toner in the container body should be removed by high-pressure washing with water or air. At this time, if the electronic data storage is in the container body, the electronic data storage may be broken by water and washing. Accordingly, it is necessary to separate the electronic data storage from the toner container before the container body of the toner container is washed. Then, the electronic data storage after input of new data is set in the toner container after washing.

In addition, when the body container of the toner container is recycled it is necessary to separate the electronic data storage from the toner container before the container body of the toner container is washed. Then, the separated electronic data storage is reused after being reset.

As another example, in U.S. Pat. No. 7,616,905, an electronic data storage (identification (ID) tag) is set on a shutter member provided on an outer circumferential surface of a toner container. More specifically, the electronic data storage (ID tag) stores (memorizes) various types of data, such as the type of toner, the production lot number of the toner, etc. The electronic data storage in the toner container and communication circuit (antennas) the image forming apparatus can exchange data.

However, in this example, because the electronic data storage is installed on the shutter member set on the outer circumferential surface of the toner container, if the user hits the toner container against something or drops the toner container carelessly, the electronic data storage may break. To prevent this failure, in this example, a recessed portion or concavity is formed in an outer circumferential surface recessed portion of the toner container and the electronic data storage is set in the recessed portion.

A problem with such recessed installation is that it can cause clogging of the toner inside the toner container in the area around the recessed portion, which of course projects inwardly into the interior of the container. As a result, the amount of the toner to be discharged through the toner outlet may become insufficient, and the retaining amount of the toner in the toner container may be increased when the toner conveyance is completed.

In view of the foregoing, there is market demand for toner containers in which an electronic data storage is installed without interfering with either the ability to easily reuse and recycle the container or the ability to convey the toner smoothly during image formation.

SUMMARY

In view of the foregoing, one illustrative embodiment of the present invention provides a toner container is removably attachable to an image forming apparatus and includes a cylindrical container body, a shutter member, a conveyance member, and a recessed portion. The cylindrical container body has a first opening in a first end thereof and a notch in a circumferential surface thereof continuous with the first opening in the first end. The flange member engages the first opening and the notch in the container body and having a toner outlet therein through which toner in the container body is discharged. The shutter member is disposed on the outer circumferential surface of the container body, and opens and closes the toner outlet by rotating together with the toner container at installation of the toner container in the image forming apparatus. The conveyance member is rotatably installed inside the container body, extending substantially along the entire inner length of the container body, and conveys the toner from a second end of the container body opposite the first end in which the first opening is formed to the toner outlet in the flange member. The recessed portion in the container body projects inward into the interior of the toner container. In the container body, a length by which the recessed portion projects inwardly into the interior of the toner container is 5 mm or less from an inner surface of the container body.

Another illustrative embodiment of the present invention provides a toner container is removably installable in an image forming apparatus and includes a container body, an electronic data storage, a first restriction member, and a second restriction member. The electronic data storage is removably attached to an outer surface of the container body. The first restriction member releasably engages the electronic data storage and restricts movement of the electronic data storage in a direction parallel to the outer surface of the toner container. The second restriction member releasably engages the electronic data storage and restricts movement of the electronic data storage in a direction perpendicular to the outer surface of the toner container.

Another illustrative embodiment of the present invention provides a method for manufacturing a toner container. The method includes forming a cylindrical container body having a first opening in a first end thereof and a notch in a circumferential surface thereof, continuous with the first opening in the first end, by blow molding or biaxial stretch blow molding, forming a first flange member to engage the first opening and the notch of the container body, having a toner outlet through which toner in the container body is discharged, by an injection molding, and fixing the first flange member on the container body by gluing or thermal welding.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 16-A1 and 16-A2, FIGS. 16-B1 and 16-B2, FIGS. 16-C1 and 16-C2, FIGS. 16-D1 and 16-D2, and FIGS. 16-E1 and 16-E2 are enlarged top views illustrating variation of mounting sections, according to a second illustrative embodiment;

FIG. 17A is a cross section view illustrating a toner container according to a third illustrative embodiment;

FIG. 17B is a schematic diagram illustrating a toner container of another embodiment;

FIG. 18-A1 is a schematic front view illustrating a container body of a toner container according to a fourth illustrative embodiment before assembling;

FIG. 18-A2 is a side view illustrating the container body shown in FIG. 18-A1;

FIG. 18-B1 is a schematic front view illustrating the container body of the toner container shown in FIG. 18-A1 after assembling;

FIG. 18-B2 is a side view illustrating the container body shown in FIG. 18-B1;

DETAILED DESCRIPTION OF PREFERRED EMBODIMENTS

Figure 1:
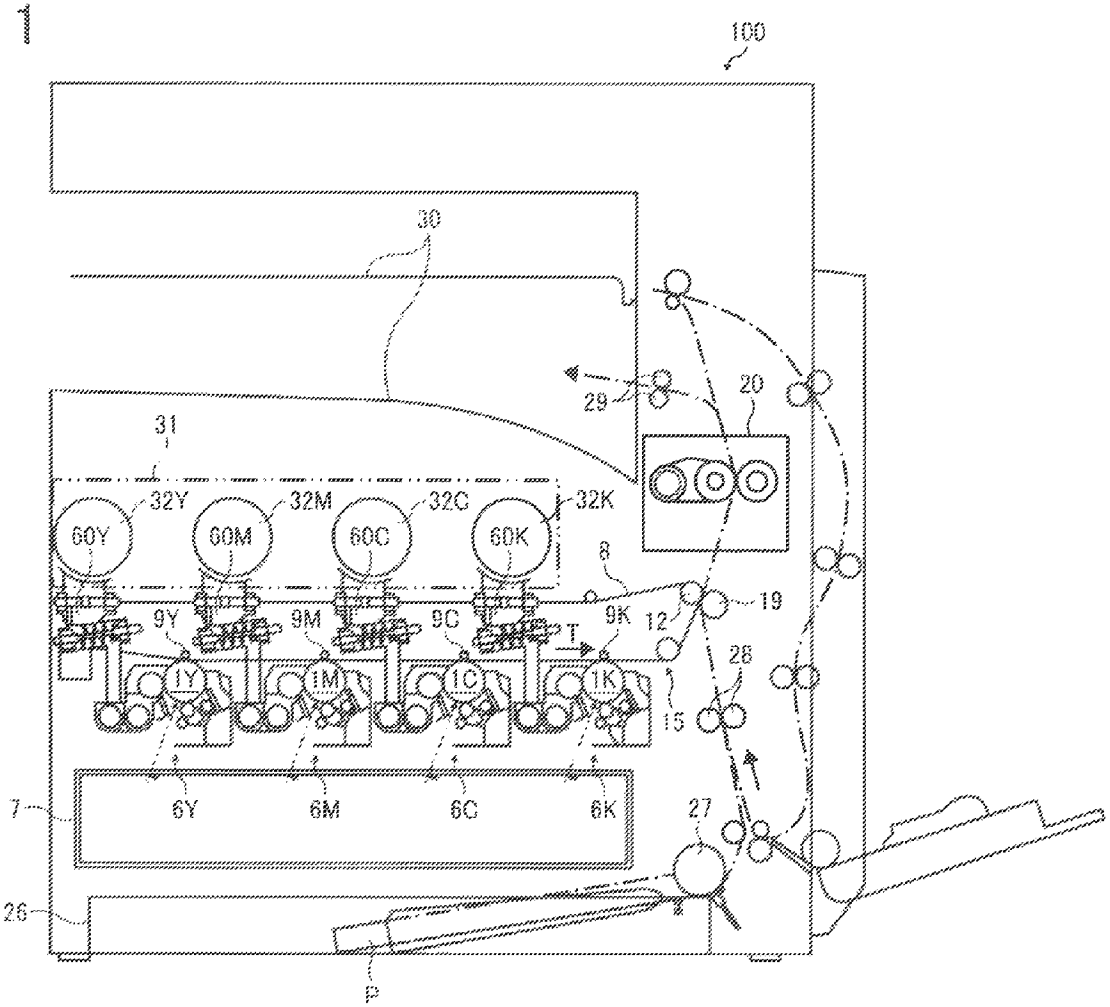
FIG. 1 is an overall schematic view illustrating a configuration of an image forming apparatus according to a first illustrative embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus that is an electrophotographic printer (hereinafter referred to as a printer) according to an illustrative embodiment of the present invention is described. It is to be noted that although the image forming apparatus of the present embodiment is a printer, the image forming apparatus of the present invention is not limited to a printer.

First Embodiment

Referring now to FIGS. 1 through 15, a first embodiment of the present invention is described in detail below.

Initially, a structure and operations of the image forming apparatus according to the present embodiment are described. FIG. 1 is a schematic diagram showing a structure of an entire image forming apparatus 100 according to the first embodiment of the present invention. As shown in FIG. 1, in a toner container frame 31 is provided in an upper part of the image forming apparatus 100, and four toner containers 32Y, 32M, 32C, and 32K respectively corresponding to yellow, magenta, cyan, and black are detachably attached to the toner container frame 31. The toner container 32Y functions as a toner container.

An intermediate transfer unit 15 is provided beneath the toner container frame 31. The intermediate transfer unit 15 includes an intermediate transfer belt 8. Image forming sections 6Y, 6M, 6C, and 6K respectively corresponding to yellow, magenta, cyan, and black are positioned to face the intermediate transfer belt 8. Toner supply devices 60Y, 60M, 60C, and 60K are provided beneath the corresponding toner containers 32Y, 32M, 32C, and 32K. Different color toner contained in the toner containers 32Y, 32M, 32C, and 32K are supplied to corresponding developing devices in the image forming sections 6Y, 6M, 6C, and 6K by the corresponding toner supply devices 60Y, 60M, 60C, and 60K.

The image forming units 6Y, 6M, 6C, and 6K are described in further detail below with reference to FIG. 2 in addition to FIG. 1, after which the elements shown in FIG. 1 that are not described above are described. In the following description, since configurations of elements for forming yellow, magenta, cyan, and black images are substantially identical to each other, in some cases, elements for yellow (given the reference character suffix Y) are described as representative.

Figure 2:
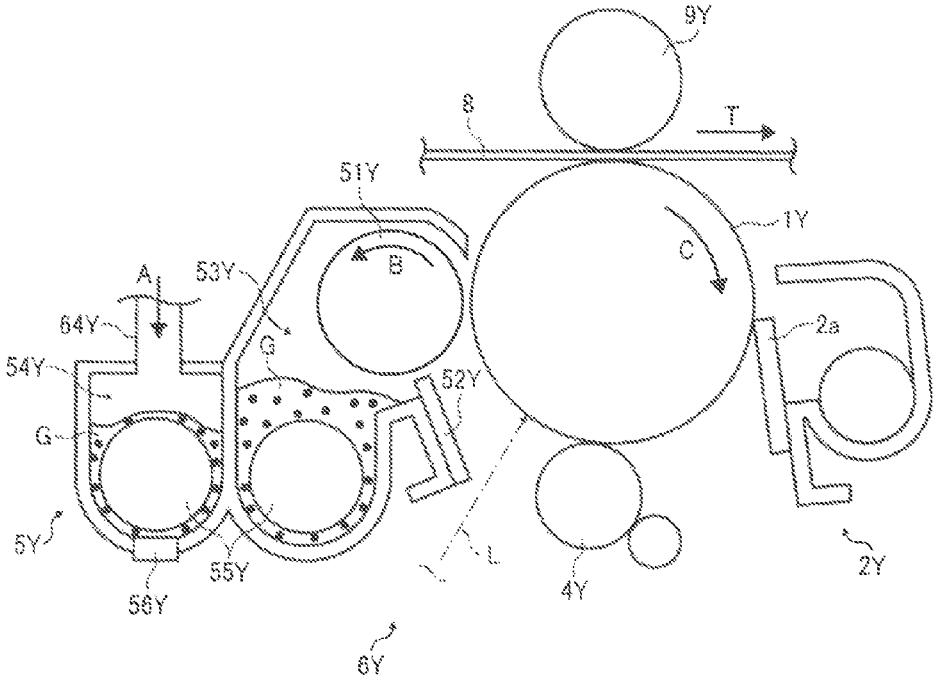
FIG. 2 is a schematic diagram illustrating an image forming unit included in the image forming apparatus shown in FIG. 1.

FIG. 2 is a schematic diagram illustrating the image forming unit 6Y included in the image forming apparatus shown in FIG. 1.

As shown in FIG. 2, the image forming unit 6Y corresponding to yellow includes a photoconductor drum 1Y, and in the vicinity of the photoconductor drum 1Y, a charging device 4Y, a developing device 5Y (developing section), a cleaning device 2Y, and a discharging device (not shown) are provided in the image forming unit 6Y. Image forming processes (a charging process, an exposing process, a developing process, a transferring process, and a cleaning process) are performed on the photoconductor drum 1Y, and a yellow image is formed on the photoconductor drum 1Y.

Each of the image forming sections 6M, 6C, and 6K has a structure substantially identical to the structure of the image forming unit 6Y and forms a corresponding color image. Therefore, in the following, the image forming unit 6Y is mainly described while omitting the descriptions of the image forming units 6M, 6C, and 6K.

In FIG. 2, the photoconductor drum 1Y is rotated in a clockwise direction indicated by arrow C, by a driving motor (not shown). Then, the surface of the photoconductor drum 1Y is uniformly charged by the charging device 4Y (the charging process), after which the surface of the photoconductor drum 1Y reaches a portion receiving a laser beam L emitted from an exposure device (see FIG. 1) and an electrostatic latent image corresponding to yellow is formed on the photoconductor drum 1Y irradiated with the laser beam L at that (the exposing process).

Then, the surface of the photoconductor drum 1Y on which the electrostatic latent image has been formed reaches a position facing the developing device 5Y, the electrostatic latent image is developed at the position, and a yellow toner image is formed (the developing process).

Then, the surface of the photoconductor drum 1Y on which the toner image has been formed reaches a position facing the intermediate transfer belt 8 and a primary transfer bias roller 9Y, and the toner image on the photoconductor drum 1Y is transferred onto the intermediate transfer belt 8 at that position (a primary transferring process). At this time, a small amount of toner that has not been transferred onto the intermediate transfer belt 8 remains on the photoconductor drum 1Y.

Subsequently, the surface of the photoconductor drum 1Y reaches a position facing the cleaning device 2Y and the toner remaining on the surface of the photoconductor drum 1Y is mechanically removed by a cleaning blade 2*a* (the cleaning process).

Finally, the surface of the photoconductor drum 1Y reaches a position facing the discharging device and electric charges remaining on the surface of the photoconductor drum 1Y are discharged.

Thus, the image forming process on the photoconductor drum 1Y is completed.

It is to be noted that the above-described image forming process is performed in the image forming units 6M, 6C, and 6K, similar to in the image forming unit 6Y. That is, the laser beams L corresponding to image data are radiated onto the corresponding photoconductor drums 1M, 1C, and 1K from the exposing device 7 positioned beneath the image forming units 6M, 6C, and 6K. Specifically, the exposing device 7 causes light sources to emit the laser beams L and irradiates the laser beams L onto the corresponding photoconductor drums 1M, 1C, and 1K via plural optical elements while the laser beams L are scanned by a rotating polygon mirror. After the developing process, the toner images formed on the respective photoconductor drums 1Y, 1M, 1C, and 1K are transferred onto the intermediate transfer belt 8 and superimposed one on another thereon. Undergoing theses processes, a multicolor image is formed on the intermediate transfer belt 8.

Returning now to FIG. 1, the intermediate transfer unit 15 includes the intermediate transfer belt 8, four primary transfer bias rollers 9Y, 9M, 9C, and 9K, a secondary transfer backup roller 12, plural tension rollers (not shown), and an intermediate transfer cleaning section (not shown). The intermediate transfer belt 8 is supported by plural rollers and is endlessly rotated in a direction indicated by arrow T shown in FIG. 1 by the secondary transfer backup roller 12.

The four primary transfer bias rollers 9Y, 9M, 9C, and 9K respectively press against the four photoconductor drums 1Y, 1M, 1C, and 1K via the intermediate transfer belt 8, thus forming primary transfer nips therebetween. A transfer bias voltage whose polarity is inverted relative to the polarity of the toner is applied to the four primary transfer bias rollers 9Y, 9M, 9C, and 9K. The intermediate transfer belt 8 sequentially passes through the primary transfer nips of the primary transfer bias rollers 9Y, 9M, 9C, and 9K while rotating in the direction indicated by the arrow T in FIG. 1. Thus, the toner images on the corresponding photoconductor drums 1Y, 1M, 1C, and 1K are primarily transferred onto the intermediate transfer belt 8 and superimposed one on another thereon.

Then, the intermediate transfer belt 8 onto which the toner images have been transferred and superimposed one on another thereon reaches a position facing a secondary transfer roller 19. A secondary transfer nip is formed at the position where the intermediate transfer belt 8 is sandwiched between the secondary transfer backup roller 12 and the secondary transfer roller 19. Then, the four-color toner image formed on the intermediate transfer belt 8 is transferred onto a recording medium P (for example, paper) carried to the secondary nip (a secondary transferring process). At this time, a certain amount of toner can remain on the intermediate transfer belt 8, not transferred onto the recording medium P.

Then, the intermediate transfer belt 8 reaches a position facing the intermediate transfer cleaning section and the toner remaining on the intermediate transfer belt 8 is removed at that position. Thus, the transfer process that is performed on the intermediate transfer belt 8 is completed.

The recording medium P is carried to the secondary nip from a paper feeding section 26 positioned at a lower part of the image forming apparatus 100 via a paper feeding roller 27, a pair of registration rollers 28, and so on.

Specifically, the plural recording media P (many pieces of paper) are stacked and stored in the paper feeding section 26. When the paper feeding roller 27 is rotated counterclockwise, a top recording medium P is carried to a position between the pair of registration rollers 28.

The recording medium P carried to the pair of registration rollers 28 is temporarily stopped at a roller nip position of the pair of registration rollers 28 whose rotation is stopped. Then, the pair of registration rollers 28 is rotated again, timed to coincide with formation of the multicolor image on the intermediate transfer belt 8, and thus the recording medium P is carried to the secondary transfer nip. Thus, the multicolor image is transferred onto the recording medium P.

The recording medium P onto which the multicolor image has been transferred in secondary transfer nip is carried to a fixing section 20 and the multicolor image on the recording medium P is fixed with heat and pressure from a fixing belt (not shown) and a pressure roller (not shown) of the fixing section 20.

The recording medium P on which the multicolor image has been formed is output to a stack section 30 via a pair of paper output rollers 29. When plural recording media P are output, the output plural recording media P are sequentially stacked on the stacking section 30. By the above processes, the image forming process in the image forming apparatus 100 is completed.

Next, with reference to FIG. 2, a structure and operations of the developing device 5Y in the image forming unit 6Y are described in detail below.

The developing device 5Y includes a developing roller 51Y facing the photoconductor drum 1Y, a doctor blade 52Y facing the developing roller 51Y, developer containers 53Y and 54Y, two developer conveying screws 55Y in the corresponding developer containers 53Y and 54Y, and a concentration detecting sensor 56Y for detecting a toner concentration in a developer G. The developing roller 51Y includes a magnet (not shown) fixed on inside of the developing roller 51Y and a sleeve (not shown) that is outermost portion of the developing roller 51 and is rotated around the magnet. The developer G (two-component developer) consisting essentially of carrier particles (toner carrier) and toner particles is contained in the developer containers 53Y and 54Y. The developer container 54Y is connected to a toner dropping route 64Y via an opening formed on an upper side of the developer container 54Y.

Next, operations of the developing device 5Y are described.

The sleeve of the developing roller 51Y is rotated in a direction indicated by arrow B shown in FIG. 2. The developer G carried on the developing roller 51Y by a magnetic field generated by the magnet is transported on the sleeve of the developing roller 51Y as the sleeve is rotated. The toner concentration of the developer G in the developing device 5Y is adjusted to a value within a predetermined range. Specifically, toner contained in the toner container 32Y (see FIG. 1) are supplied to the developer container 54Y via the toner supply device 60Y (see FIG. 1) corresponding to a consumed amount of toner in the developing device 5Y. The toner supply device 60Y is described below in detail.

The toner supplied to the developer container 54Y are mixed with the developer G in the developer container 54Y, and the developer G is circulated in the two developer containers 53Y and 54Y while the developer G is stirred by the developer conveying screws 55Y. The developer G is moved in the direction perpendicular to the plane of the paper on which FIG. 2 is drawn. The toner in the developer G adhere to carrier particles due to a friction charge with the carrier particles and are thus carried on the developing roller 51Y with the carrier particles by a magnetic force formed on the developing roller 51Y.

The developer G carried on the developing roller 51Y reaches the doctor blade 52Y by being carried in the direction indicated by the arrow B in FIG. 2. The amount of the developer G on the developing roller 51Y is adjusted to a suitable value by the doctor blade 52Y and the developer G whose amount is adjusted is carried to a position facing the photoconductor drum 1Y. The position is a developing region. The toner in the developer G are attracted to an electrostatic latent image formed on the photoconductor drum 1Y by an electric field generated in the developing region. The developer G remaining on the developing roller 51Y reaches an upper part in the developer container 53Y by the rotation of the sleeve and the remaining developer G drops from the developing roller 51Y.

Next, referring to FIGS. 3 through 7, the toner supply devices 60Y, 60M, 60C, and 60K are described below.

Figure 3:
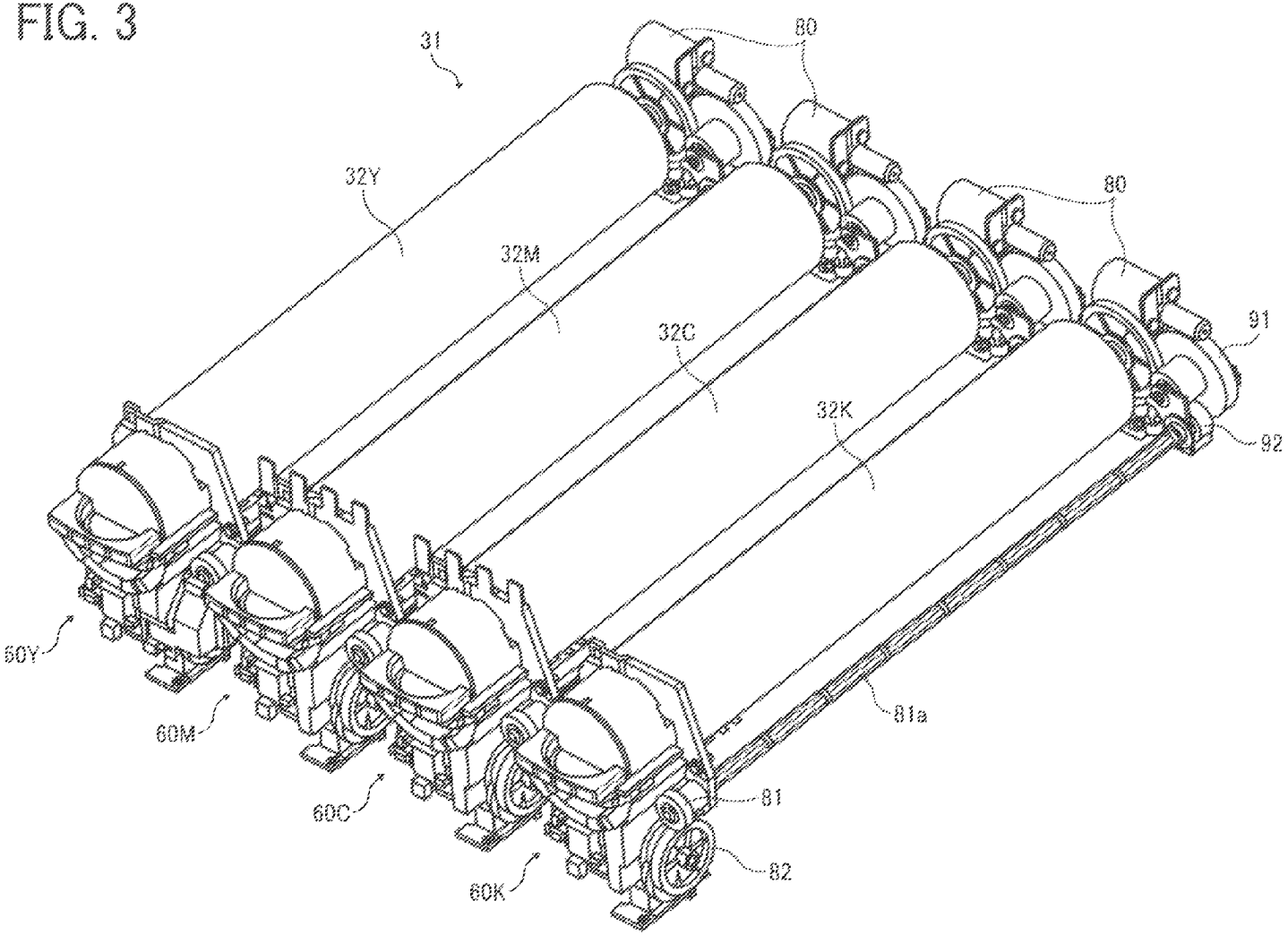
FIG. 3 is a perspective view of a toner container frame included in the image forming apparatus shown in FIG. 1.
Figure 4:
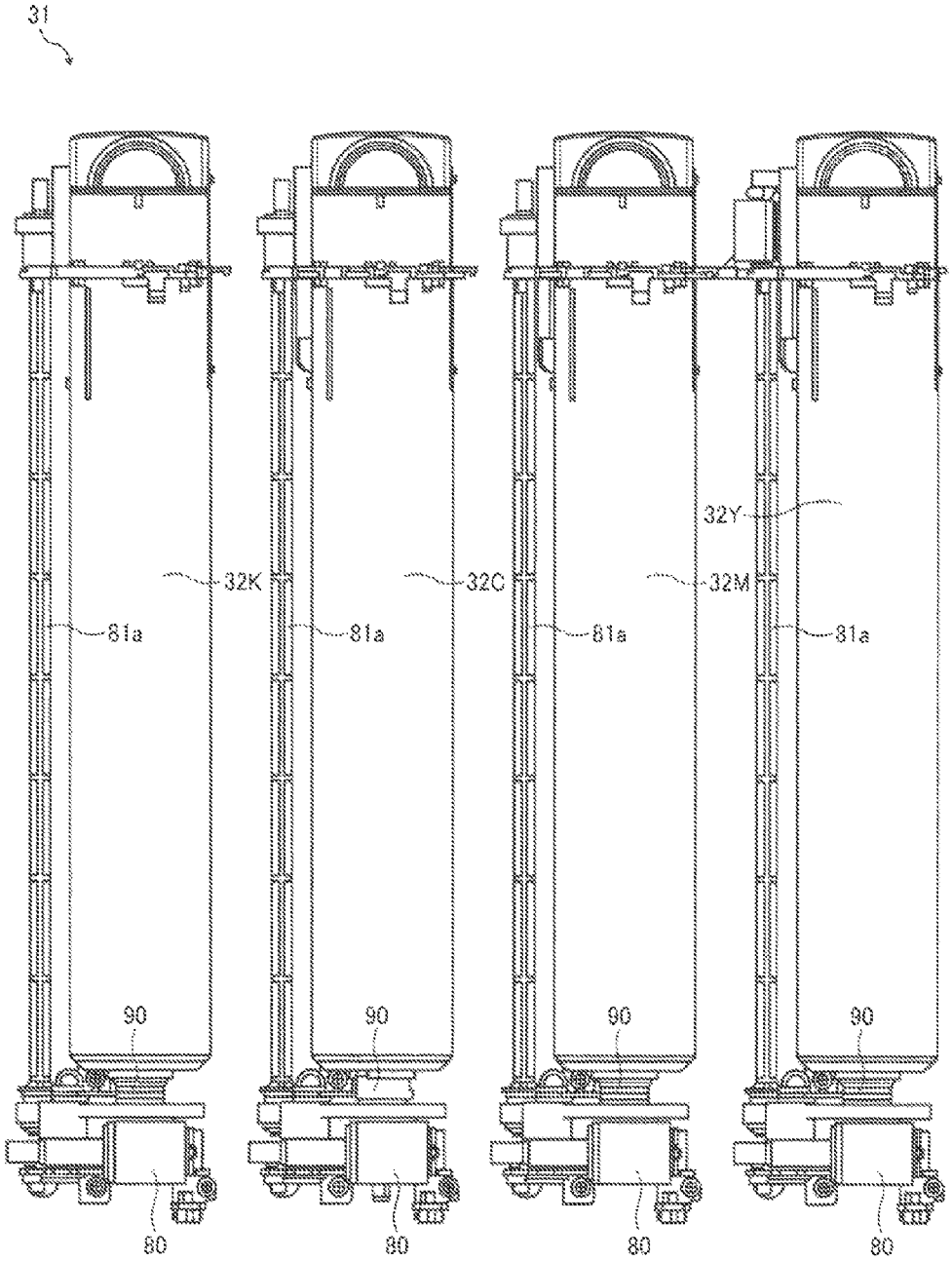
FIG. 4 is a top view of the toner container frame shown in FIG. 3.
Figure 5A:
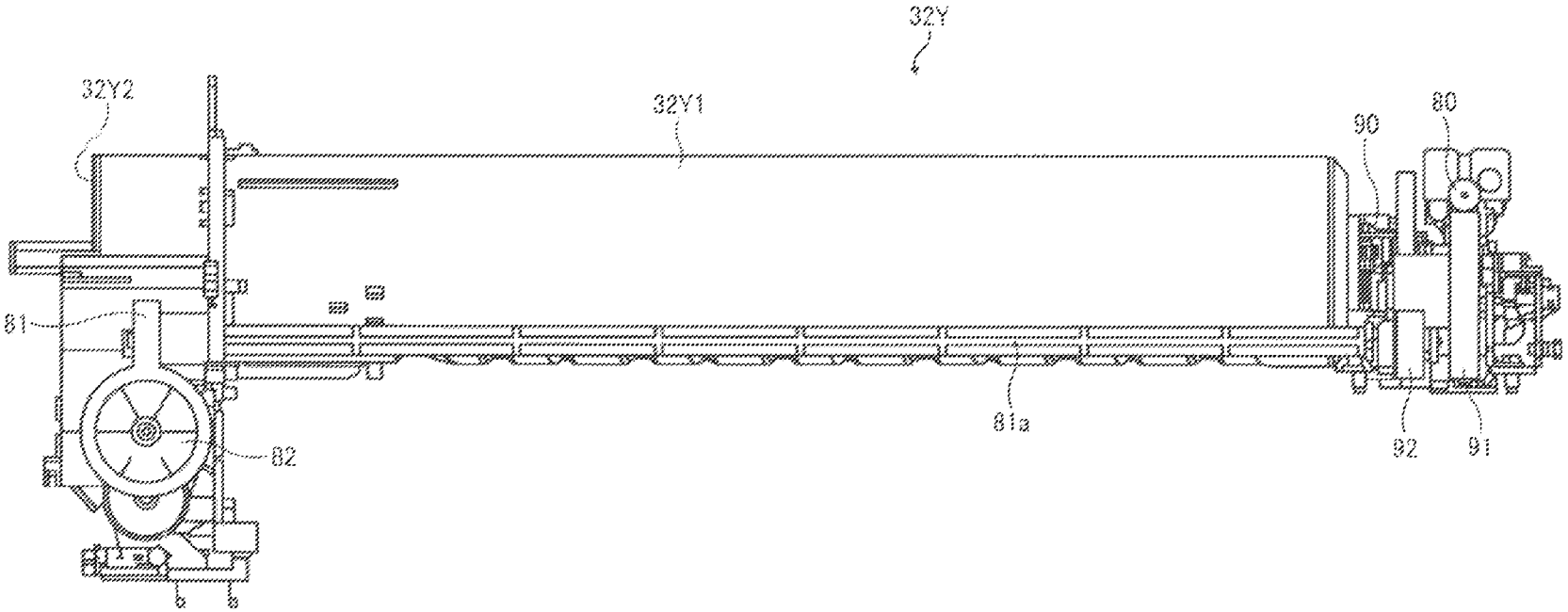
FIG. 5A is a side view of a structure of a part of the toner container frame shown in FIG. 3 including a toner container.
Figure 5B:
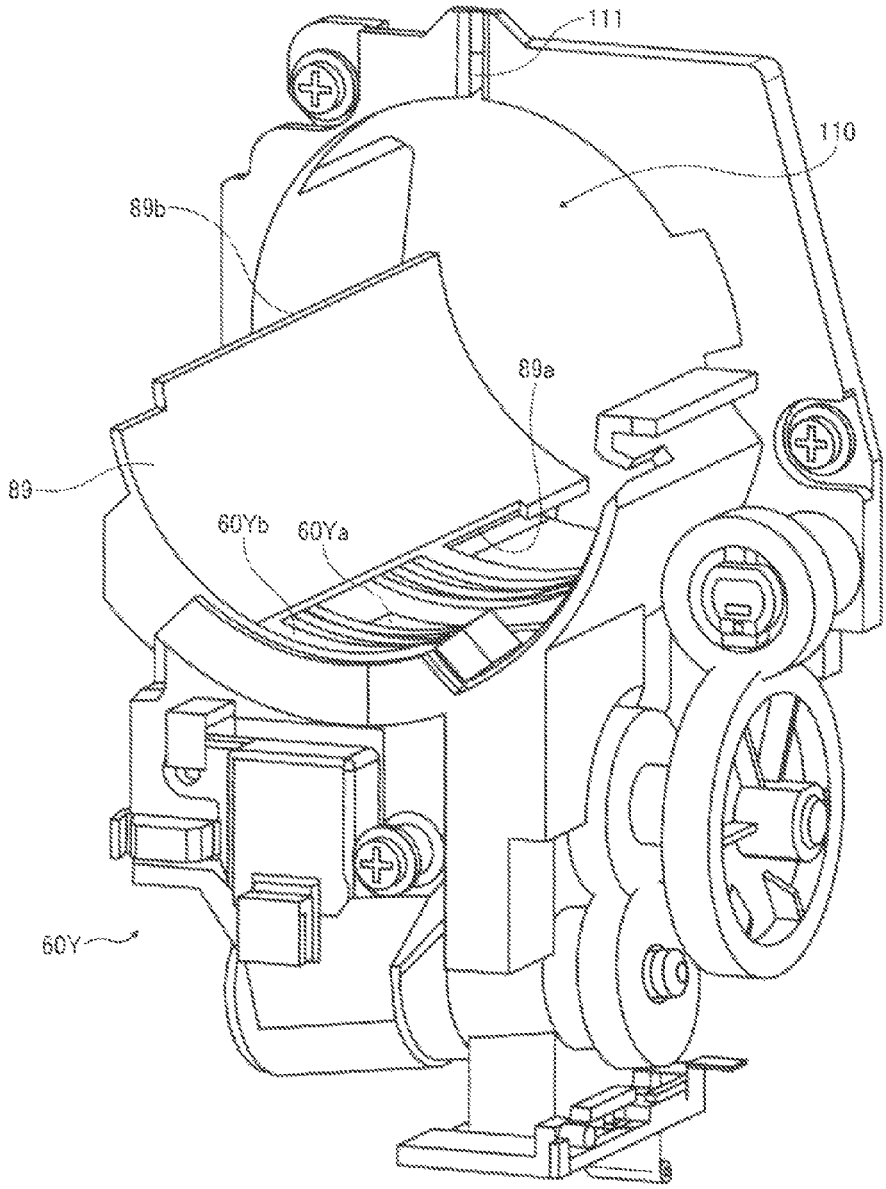
FIG. 5B is a perspective view illustrating a toner supplying device in the toner container frame shown in FIG. 3.

FIGS. 3 and 4 are a perspective view and a top view of the toner container frame 31 included in the image forming apparatus 100 shown in FIG. 1, respectively. FIG. 5A is a side view of the structure of a part of the toner container frame 31 including the toner container 32Y shown in FIG. 4. FIG. 5B is a perspective view illustrating the toner supplying device 60Y when a shutter member 89 is attached to a supply opening 60Ya. In FIGS. 3 through 5B, the toner contained in the corresponding toner containers 32Y, 32M, 32C, and 32K in the toner container frame 31 are suitably supplied to the corresponding developing devices by the corresponding toner supply devices 60Y, 60M, 60C, and 60K according to the consumed amounts of the corresponding toner. The structure of each of the toner supply devices 60Y, 60M, 60C, and 60K is substantially equal, and the structure of each of the toner containers 32Y, 32M, 32C, and 32K is substantially equal. Therefore, the toner supply device 60Y and the toner container 32Y are described as representative.

In FIGS. 3 through 5B, when the toner container 32Y is installed in the toner container frame 31, a shutter member 32Y4 (shown in FIG. 9) of the toner container 32Y is moved in synchronization with the installation of the toner container 32Y, and a toner outlet W (see FIG. 7) of the toner container 32Y is opened.

In addition, the shutter 89 (main body side shutter, see FIG. 5B) of the image forming apparatus 100 is moved and the toner supply opening 60Ya (see FIG. 5B) of the toner supply device 60Y is opened. Consequently, the toner outlet W communicates with the toner supply opening 60Ya. Accordingly, the toner contained in the toner container 32Y are discharged from the toner container 32Y through the toner outlet W and the toner supply opening 60Ya and are stored in a toner tank of the toner supply device 60Y.

Figure 7:
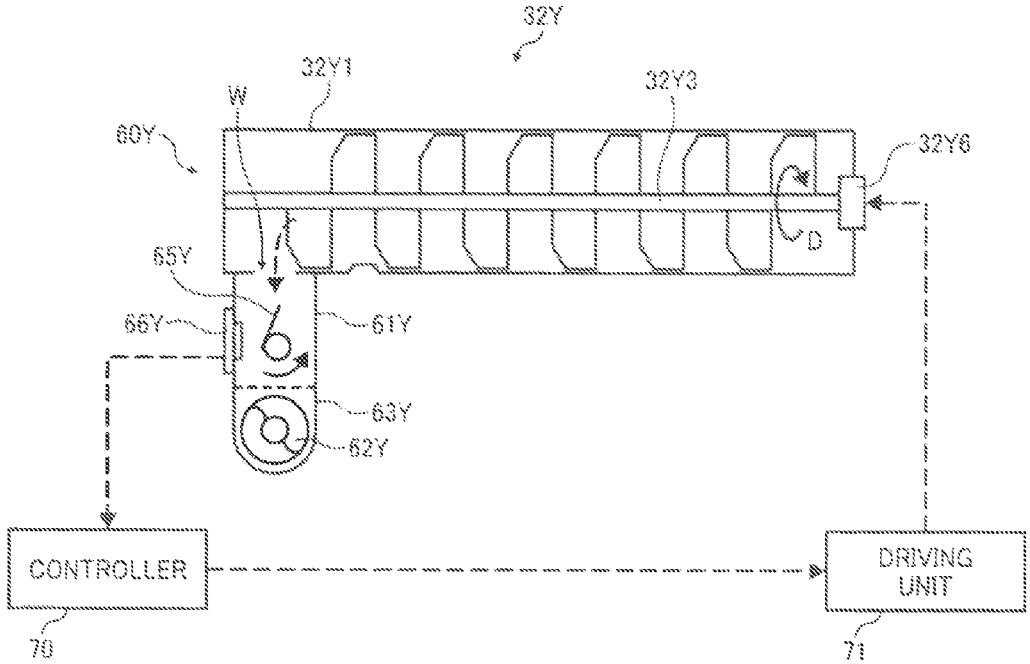
FIG. 7 is a pattern diagram showing supply of toner to the toner supply device shown in FIG. 5B from the toner container connected to the toner supply device.

In FIG. 3, reference characters 80, 90, and 91 respectively represent a driving motor, a driving coupling member, and a gear, together forming a driving unit 71 shown in FIG. 7.

Herein, FIG. 7 is a pattern diagram showing supply of toner to the toner supply device 60 from the toner container 32Y connected to the toner supply device 60.

Referring to FIGS. 3 and 7, the toner container frame 31 includes the toner supply devices 60Y, 60M, 60C, and 60K, the driving motor 80, a driving coupling 90, gear lines 81, 82, 91, and 92, a driving transmission shaft 81*a*, and an antenna substrate 120. The driving motor 80, the driving coupling 90, the gear lines 81, 82, 91, and 92 form a driving unit 71. The toner supply device 60Y includes a toner tank 61Y, a toner conveying path 63Y, a toner conveying screw 62Y, the toner dropping route 64Y, a toner agitator 65Y, and a toner end sensor 66Y (detecting unit).

As shown in FIG. 7, a container body 32Y1 of the toner container 32Y is a substantially cylindrical toner bottle and includes a conveyance member 32Y3 that is rotatably attached thereto, and a shaft coupling 32Y6. The toner outlet W is formed on a lower side of the container body 32Y1. Referring to FIGS. 5A and 7, the conveyance member 32Y3 is rotated in a direction indicated by arrow D shown in FIG. 7 by the driving unit 71 that includes the driving motor 80, the driving coupling member 90, the gear 91, and the like. Then, the conveyance member 32Y3 conveys the toner contained in the container body 32Y1 in a longitudinal direction of the toner container 32Y (from the left to the right in FIG. 7) and discharges the toner from the toner outlet W.

That is, the conveyance member 32Y3 of the toner container 32Y is rotated by the driving unit 71 as required, thus supplying the toner suitably to a toner tank 61Y of the toner supply device 60. When the service life of each of the toner containers 32Y, 32M, 32C, and 32K has expired, that is, when almost all toner in the toner container 32Y have been consumed, an old one is replaced with a new one.

In FIGS. 3 through 6, the driving coupling member 90 is positioned on the backside of the toner supply device 60Y, that is, on the backside of a direction in which the toner container 32Y is attached to the toner container frame 31 (hereinafter "toner container attachment direction"), and engages the shaft coupling 32Y6 (see also FIGS. 10 and 11A). The shaft coupling 32Y6 is formed on a bottom side of the conveyance member 32Y3 in the toner container 32Y and rotates with the conveyance member 32Y3. A driving force of the driving motor 80 is transmitted to the driving coupling member 90 via the gear 91 (double gear), and the container body 32Y1 of the toner container 32Y is rotated in a predetermined direction by the driving coupling member 90.

The gear 92 that engages the gear 91 transmits the driving force to the gear 81 positioned on the front side of the toner supply device 60Y via the driving force transmitting shaft 81*a*. The driving force transmitted to the gear 81 rotates the toner conveying screw 62Y and the toner agitator 65Y via the gear train formed of the gears 81 and 82.

As shown in FIG. 1, when a main body cover (not shown) positioned on the front side of the image forming apparatus 100 is opened, the toner container frame 31 is exposed. That is, attachment and removal of the toner containers 32Y, 32M, 32C, and 32K are performed from the front side of the image forming apparatus 100 in the longitudinal direction of the toner containers 32Y, 32M, 32C, and 32K, that is, a direction orthogonal to the surface of paper on which FIG. 1 is drawn.

Figure 6A:
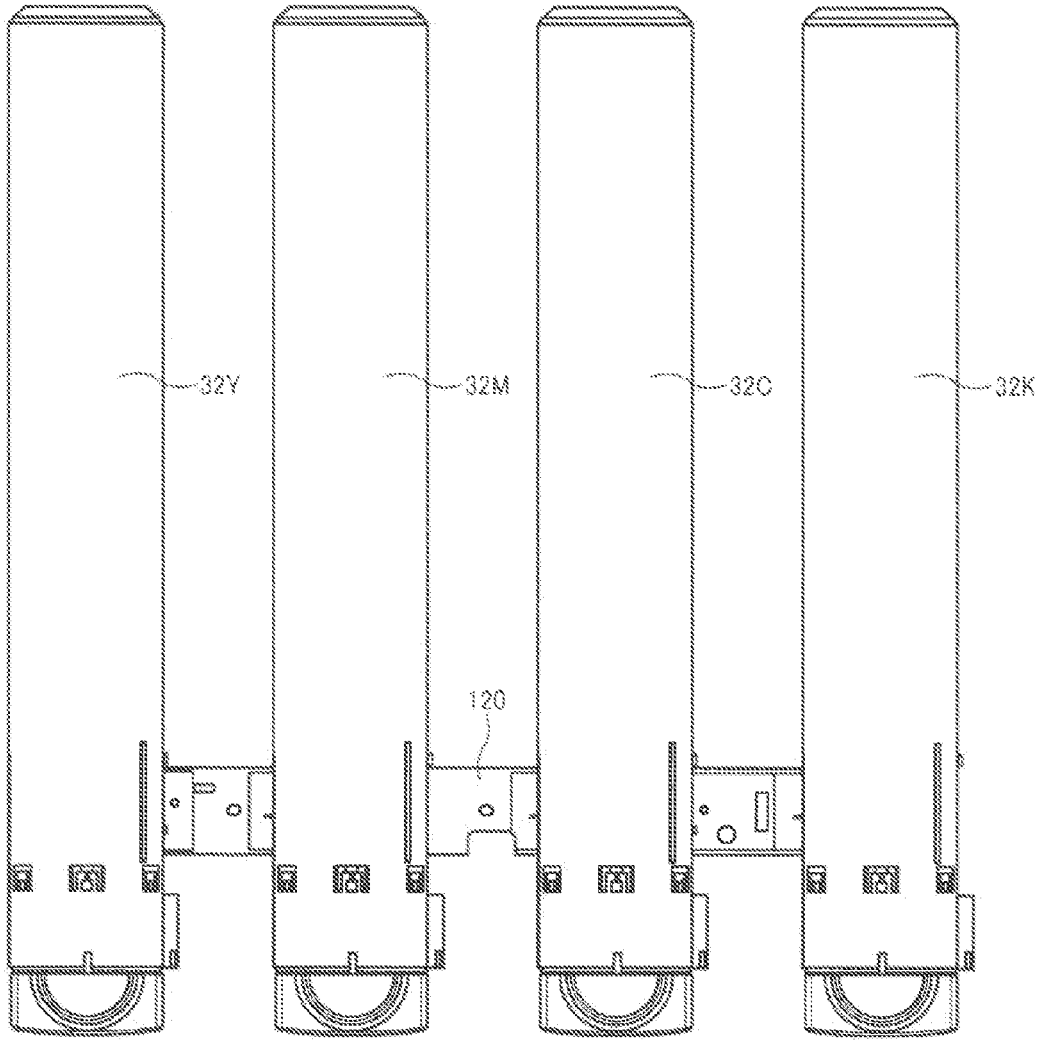
FIG. 6A is a top view illustrating the toner container frame shown in FIG. 3 and the four toner containers.
Figure 6B:
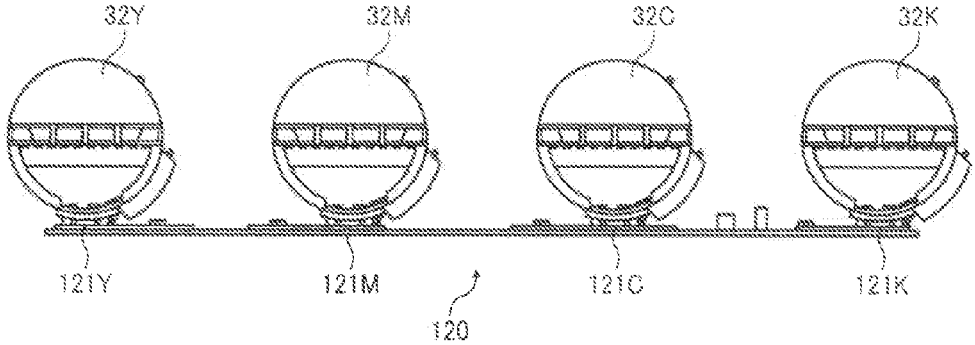
FIG. 6B is a front view illustrating the four containers when the toner containers are attached to the toner container frame shown in FIG. 3

FIG. 6A is a top view illustrating the toner container frame 31 and the four toner containers 32 shown in FIG. 1. FIG. 6B is an end-on (front) view illustrating the four containers 32 when the containers 32 are attached to the toner container frame 31.

As shown in FIGS. 6A and 6B, the antenna substrate 120 is positioned on a supporting part (not shown) of the toner container frame 31. Specifically, four antennas 121Y, 121M, 121C, and 121K are positioned on a surface of the antenna substrate 120. The four antennas 121Y, 121M, 121C, and 121K communicate with radio fluency identification (RFID) tags 32Y10, 32M10, 32C, and 32K (see FIGS. 8 through 10), serving as electronic data storages, installed in respective mounting sections 32Y1*c*, 32M1*c*, 32C1*c*, and 32K1*c* positioned on the circumferential surfaces of the corresponding toner containers 32Y, 32M, 32C, and 32K. The toner container 32Y, 32M, 32C, and 32K are aligned on the antenna substrate 120 so that the RFID 32Y10, 32M10, 32C10, and 32K10 face the antennas 121Y, 121M, 121C, and 121K, respectively.

In addition, the antenna substrate 120 is positioned beneath the toner containers 32Y, 32M, 32C, and 32K, in the supporting part of the toner container frame 31. Accordingly, the RFID 32Y10, 32M10, 32C10, and 32K10 of the toner container 32Y, 32M, 32C, and 32K and the antennas 121Y, 121M, 121C, and 121K of the antenna substrate 120 positioned in the image forming apparatus 100 exchange data.

The data exchanged between the toner container 32Y, 32M, 32C, and 32K and the image forming apparatus 100 includes, for example, the production serial number of the toner container, the recycle number of the toner container, the type of toner, the production lot number of the toner, the production date of the toner, the manufacturer of the toner, the amount of toner in the toner container, the multicolor of toner, and a usage history of the image forming apparatus 100. Other data may also be included.

The RFID 32Y10, serving as the electronic data storage, stores above-described data set before RFID 32Y10 is installed in the image forming apparatus 100. Alternatively, the RFID 32Y10 receives the above-described data from image forming apparatus after the RFID 32Y10 is installed in the image forming apparatus 100.

In the first embodiment of the present invention, with reference to FIGS. 6A and 6B, the antenna substrate 120 (the antenna 121Y) is positioned downstream from the toner outlet W of the toner container 32Y in the toner container attachment direction in the toner container frame 31.

In this configuration, even if toner leaks from the toner outlet W, the toner is less likely to drop to the antenna 120 substrate positioned downstream from the toner outlet W of the toner container in the toner container attaching direction. Consequently, the decrease of the communication sensitivity due to the drop of the toner at a position between the RFID 320Y10 and the antenna 121Y can be prevented.

Turning now to FIGS. 5A and 7, a structure and operations of the toner supply device 60Y are described below.

FIG. 5A is a side view illustrating the toner supply device 60Y. FIG. 7 is a diagram the toner container 32Y set in the toner container frame 31 included in the toner supply device 60. In FIGS. 5A and 7, the toner tank 61Y, the toner conveying screw 62Y, the toner dropping route 64Y (shown in FIG. 2), the toner agitator 65Y, the toner end sensor 66Y (detector), the gear train formed of the gears 81 through 84, a toner receiving section 85 (see FIG. 3), the shutter 89 (main body side shutter shown in FIG. 5B) are provided on the front side of the toner supply device 60.

The toner tank 61Y is positioned beneath the toner outlet W of the container body 32Y1 of the toner container 32Y and stores the toner discharged through the toner outlet W from the toner container 32Y via the toner supply opening 60Ya (see FIG. 5B). The bottom part of the toner tank 61Y is connected to an upstream side in the developer conveyance direction of the toner conveying screw 62Y in the conveyance path 63Y.

The toner end sensor 66Y is disposed on a wall surface of the toner tank 61Y, at a position having a predetermined height from the bottom surface of the toner tank 61Y. The toner end sensor 66Y detects that the amount of the toner stored in the toner tank 61Y becomes less than a predetermined amount. As the toner end sensor 66Y, a piezoelectric sensor can be used.

With reference to FIG. 7, when the toner end sensor 66Y detects a signal indicating that the amount of the toner stored in the toner tank 61Y is less than the predetermined value, the signal is sent to a controller 70. The controller 70 controls the driving unit 71 (the driving motor 80, the driving coupling member 90, and the gear 91 shown in FIG. 5) to rotate the toner container 32Y for a predetermined period so as to supply toner to the toner tank 61Y.

When the toner end sensor 66Y continues to detect the signal even if the driving unit 71 repeats rotating the toner conveyance member 32Y3 in the toner container 32Y during a predetermined time period, the controller 70 determines that no toner remains in the toner container 32Y. Then, the controller 70 displays a message that instructs users to replace the toner container 32Y with a new one on a display (not shown) of the image forming apparatus 100.

The toner agitator 65Y (rotating member) is disposed at an inner center position of the toner tank 61Y near the toner end sensor 66Y for preventing the toner stored in the toner tank 61Y from being coagulated. The toner agitator 65Y includes a flexible member (not shown) provided on a shaft, rotates in a clockwise direction indicated by arrow D shown in FIG. 7, and stirs the toner in the toner tank 61Y. In addition, since the tip of the flexible member of the toner agitator 65Y slidably contacts the detecting surface of the toner end sensor 66Y with a rotational cycle of the toner agitator 65Y, a decrease in the detecting accuracy due to toner adhering to the detecting surface of the toner end sensor 66Y is prevented.

The toner conveying screw 62Y conveys the toner retained in the toner tank 61Y obliquely upward. More specifically, the toner conveying screw 62Y linearly conveys the toner from the bottom side of the toner tank 61Y to the upper side of the developing device 5Y. Then, the toner thus conveyed by the toner conveying screw 62Y drops under its own weight and is supplied to the development device 5 (developer container 54Y).

Referring to FIGS. 8 through 15, configuration and operation of the toner container 32Y is described below.

As shown in FIGS. 8 through 15, the toner container 32Y that is cylindrical includes the container body 32Y1, a flange member 32Y2, the conveyance member 32Y3, and the shutter member 32Y4. In addition, the RFID 32Y10, serving as an electronic data storage, is set in the toner container 32Y.

Figure 11A:
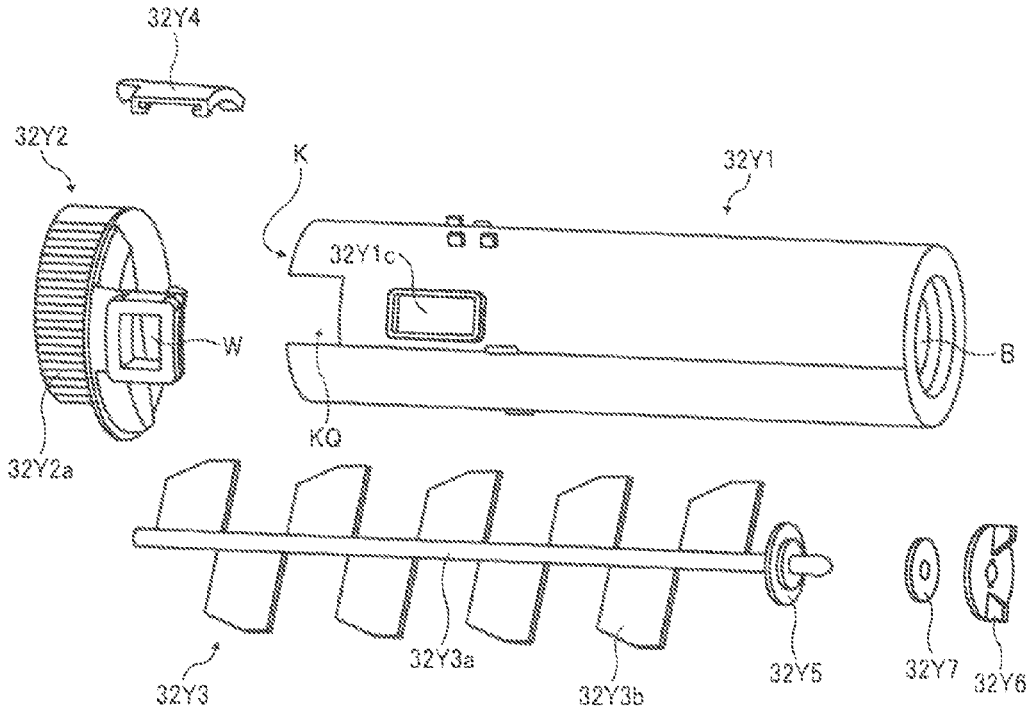
FIG. 11A is an exploded view illustrating the toner container shown in FIG. 8, including a flange member shown in FIG. 8.

As shown in FIG. 11A, in the toner container 32Y, a front-side opening K, serving as a first opening, is formed in one end of the container body 32Y1 so that the container body 32Y1 fits into the flange member 32Y2, and the conveyance member 32Y3 is provided inside the container body 32Y1. The toner outlet W is formed in the flange member 32Y2 and overlaps a notch KQ of the container body 32Y1. The flange member 32Y2 functions as a first flange member.

Figure 11B:
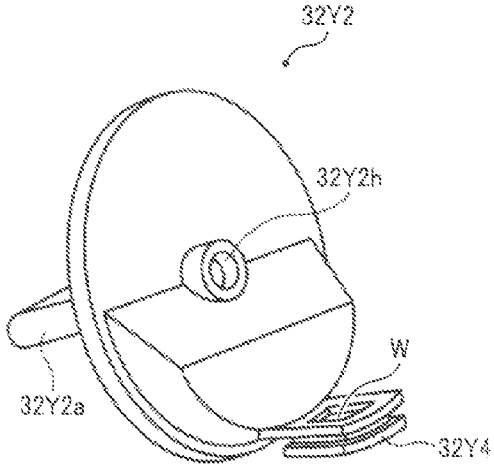
FIG. 11B shows the flange member viewed from another angel different from that in FIG. 11A.

FIG. 11B shows the flange member 32Y2 viewed from another angle different from that shown in FIG. 11A by approximately 90 degrees. As shown in FIG. 11B, a bearing boss 32Y2*h* is formed on the inner side of the flange member 32Y and receives a rotary shaft 32Y3*a* of the conveyance member 32Y3. It is to be noted that, in FIG. 11B, reference character 32Y2*a* represents a handle part.

With reference to FIG. 11A, the container body 32Y1 is cylindrical, and the front-side opening K is formed on one end side (front side) thereof, and a bottom-side opening B is formed on the other end side (on the side of the driving unit 71 shown in FIG. 7) thereof. In addition, the notch KQ is formed on a circumferential surface of the container body 32Y1 and continuous with the front-side opening K. The flange member 32Y2 joins the container body 32Y1 so that the toner outlet W formed in the flange member 32Y2 is positioned facing the notch KQ. On the other hand, a bearing 32Y5 that rotatably holds the bottom side of the conveyance member 32Y3 fits in the bottom-side opening B formed on the bottom side (on the driving unit 71 side) of the container body 32Y1. Further, on the bottom side of the container body 32Y1, a seal member 32Y7 is provided on the rotary shaft 32Y3*a* of the conveyance member 32Y3 so that the seal member 32Y7 covers the bearing 32Y5 from external side. Further, the shaft coupling 32Y6 is fixed on an outer face of the seal member 32Y7. The one end (front end) of the conveyance member 32Y3 is inserted into the bearing boss 32Y2*h* formed in the inner face of the flange member 32Y2 (see FIG. 11B) and thus held.

Because the shaft coupling 32Y6 provided bottom end of the conveyance member 32Y3 engages the driving coupling 90 in the image forming device 100 (see FIG. 5A), the conveyance member 32Y3 provided in the container body 32Y1 rotates by receiving a driving force from the driving coupling 90. Therefore, the toner contained in the container body 32Y1 is conveyed from the bottom side of the container body 32Y1 to the toner outlet W in the longitudinal direction. Then, the toner thus conveyed is discharged from the toner outlet W and is supplied to the toner tank 61Y of the toner supply device 60Y (see FIG. 7).

Figure 8:
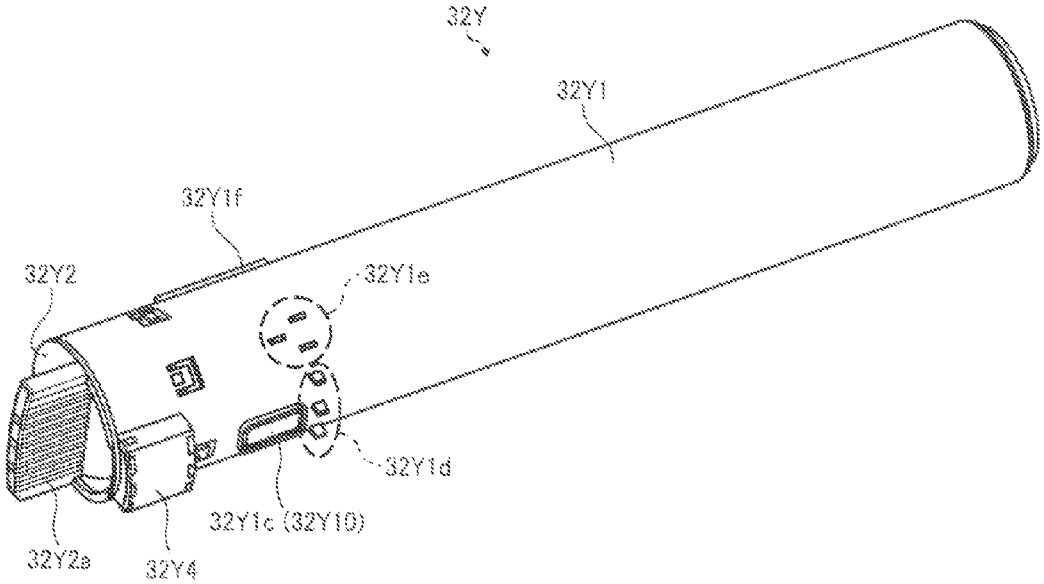
FIG. 8 is a perspective view illustrating the toner container shown in FIG. 5A when a shutter member of the toner container is closed.
Figure 9:
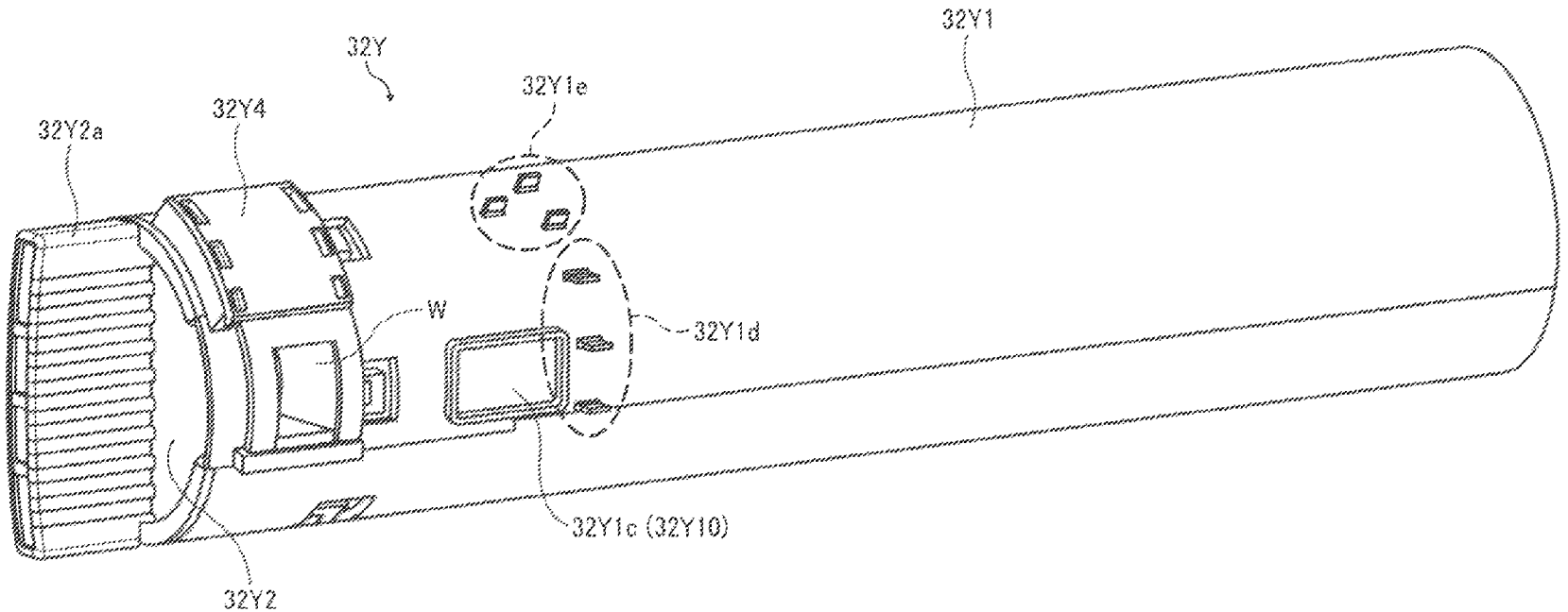
FIG. 9 is a perspective view illustrating the toner container shown in FIG. 8 when a shutter member of the toner container is opened.

Turning now to FIGS. 8 and 9, the mounting section 32Y1*c* in which the RFID 32Y10 (printed circuit board) is set, protrusion members 32Y1*d* used for identifying compatibleness, color discrimination ribs 32Y1*e*, and a guide rib 32Y1*f* are provided on the outer circumferential surface of the container body 32Y1.

The mounting section 32Y1*c* in which the RFID 32Y10 is set is recessed, projecting inwardly from the container body 32Y1 to the interior recessed portion. The RFID 32Y10 is set in the recessed mounting section 32Y1*c* in the toner container 32Y without gluing and thermally. Therefore, because the RFID 32Y10 is set in the recessed mounting section 32Y1*c*, even when the user hits the toner container 32Y against something or drops the toner container 32Y carelessly, the RFID 32Y10 can be prevented from breaking. The structure and the operation of the mounting section 32Y1*c* are described in further detail later.

As shown in FIGS. 8 and 9, the protrusion members 32Y1*d* formed on the outer surface of the container body 32Y1 engage the toner container frame 31 when a toner container 32Y is installed in the image forming apparatus 100 in the longitudinal direction to prevent a wrong type of toner container from being attached to the toner container frame 31 (see FIG. 4). For example, it is assumed that one manufacturer supplies image forming apparatuses A and toner containers A1 dedicated to them to one sales company, and the sales company sells the image forming apparatuses A with a different name (different brand). In such a case, with the protrusion members 32Y1*d*, the toner containers A1 can be discriminated from other toner containers sold by that sales company. The protrusion members 32Y1*d* and the shutter member 32Y4 closing the toner outlet W surround the RFID 32Y10 on the outer circumferential surface of the toner container 32Y.

In addition, the color discrimination ribs 32Y1*e* are formed on the outer surface of the container body 32Y1 to prevent the toner container 32M, 32C, or 32K that contains toner other than yellow toner from being connected to the toner supply device 60Y (see FIG. 4). That is, because the color discrimination ribs 32Y1*e* used for yellow (see FIGS. 8 and 9), color discrimination ribs 32M1*e* used for magenta, color discrimination ribs 32C1*e* used for cyan, and color discrimination ribs 32K1*e* used for black are positioned differently from each other, each of the toner supply devices 60Y, 60M, 60C, and 60K can engage only the corresponding color of the toner container 32 among the toner containers 32Y, 32M, 32C, and 32K in accordance with the identification of the color discrimination ribs 32Y1*e*, 32M1*e*, 32C1*e*, and 32K1*e*.

Moreover, the guide rib 32Y1*f* is formed on the outer surface of the toner container 32Y to guide the toner container 32Y so that the toner container 32Y can be attached to and detached from an inserting opening (not shown) of the toner supply device 60Y in a correct position.

The container body 32Y1 is formed of a resin material, such as polyethylene terephthalate (PET), polyethylene (PE), or polypropylene (PP), and is formed by blow molding, or biaxial stretch blow molding. When the blow molding or biaxial stretch blow molding is used, the mounting section 32Y1*c*, recessed from the outer circumferential surface to accommodate the RFID 32Y10 therewithin, can be easily formed.

By contrast, the flange member 32Y2 is formed of resin member such as polystyrene and is formed by injection molding. The flange member 32Y2 is fixed on the container body 32Y1 by gluing or thermally welding a portion in contact with the container body 32Y1 to the container body 32Y1. When the flange member 32Y2 is glued to the container body 32Y1, it is favorable that the adhesive is applied to the outer circumferential surface of the contact portion after the flange member 32Y2 joins the container body 32Y1. When the flange member 32Y2 and the container body 32Y1 are joined together using adhesive, a device for joining them can become inexpensive, and adhesion strength of the container body 32Y1 and the flange member 32Y2 can be increased. When the flange member 32Y2 and the container body 32Y1 are joined together by thermally welding, after the flange member 32Y2 joints the container body 32Y1, the outer circumferential surface of the contact portion is heated. In this adhesion process of the flange member 32Y2 using thermal welding, as compared with the connection using the adhesive, because a dry time of the adhesion is not necessary, productivity of the toner container 32Y can be increased.

It is to be noted that, in production process, after gluing or thermal welding of the flange member 32Y2 and the container body 32Y1 is completed (after assembly process of the toner container 32Y), the toner is put in the toner container 32Y through the toner outlet W.

In FIGS. 8 through 11, the flange member 32Y2 includes the handle part 32Y2*a*, the shutter member 32Y4, and the toner outlet W are formed in the flange member 32Y2. A seal member (sponge) 32Y4*s* shown in FIG. 10 formed of polyurethane farm is stuck on an inner face of the shutter member 32Y4.

The shutter member 32Y4 is provided on the outer circumferential surface of the toner container 32Y (flange member 32Y2) so that toner outlet W opens and closes as the flange member 32Y2 rotates together with the toner container 32Y when the toner container 32Y is connected to the toner supply device 60Y of the image forming apparatus 100.

Specifically, when the toner container 32Y is attached to the toner supply device 60Y of the image forming apparatus 100, the user presses the container body 32Y1 of the toner container 32Y to insert the toner container 32Y into an insertion opening 110 (see FIG. 5B) formed in the toner supplying device 6 of the image forming apparatus main body 100 from the bottom section of the container body 32Y1 while holding the handle part 32Y2*a* of the toner container 32Y (flange member 32Y2). At this time, the aspect of the toner container 32Y in a circumferential direction is restricted by engaging the guide rib 32Y1*f* on the toner container 32Y with a guide groove 111 (shown in FIG. 5B) of the toner supply device 60 (the image forming apparatus 100).

Subsequently, when the toner container 32Y is further pushed while the aspect of the toner container 32Y in the circumferential direction is restricted, the shaft coupling 32Y6 formed at the bottom of the toner container 32Y is engaged with the driving coupling member 90 of the image forming apparatus 100. Then, when the handle part 32Y2*a* is manually rotated by approximately 90 degrees in a clockwise direction, the shutter member 32Y4 engages an engaging member (not shown) in the supply device 60Y, thereby stopping the rotation of the toner container 32Y, and the toner outlet W is opened. At this time, the toner outlet W opens downward, and engages the toner supply opening 60Ya (see FIG. 5B) of the toner tank 61Y, and the toner container 32Y including the flange member 32Y2 and the container body 32Y1 is fixedly held by the toner supply device 60Y.

By contrast, when the toner container 32Y is detached from the toner supply device 60Y in the image forming apparatus 100, the above-described operations are performed in the reverse sequence.

In this configuration, because the seal member (sponge) 32Y4*s* formed of polyurethane farm is stuck on the inner face of the shutter member 32Y4 in a portion facing the toner outlet W and the vicinity of the toner outlet W, the toner outlet W of the toner container 32Y is sealed by the seal member (sponge) 32Y4*s* and the shutter member 32Y4 when the shutter member 32Y4 closes the toner outlet W (state shown in FIG. 8). Accordingly, leakage of the toner from the toner outlet W and its vicinity can be prevented.

Figure 10:
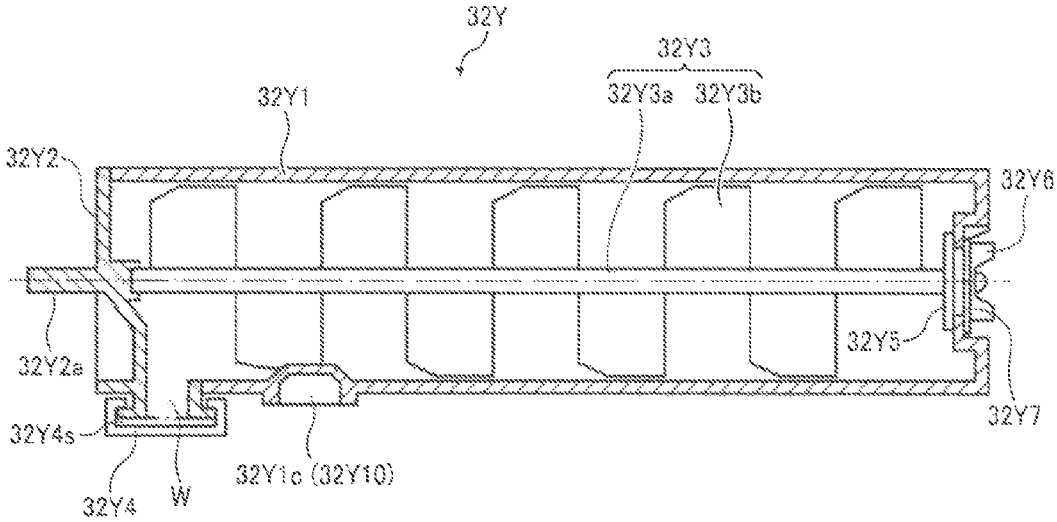
FIG. 10 is a cross section view illustrating the toner container shown in FIG. 8.

Turning now to FIGS. 10 through 11B, the configuration of the conveyance member 32Y3 in the toner container 32Y is described below.

The conveyance member 32Y3 includes the rotary shaft 32Y3*a* and multiple blades 32Y3*b* formed of a resin material such as thin film PET, having a thickness of approximately 188 μm, provided in an axial direction.

The top end of the rotary shaft 32Y3*a* of the conveyance member 32Y3 is supported by the bearing boss 32Y2*h* of the flange member 32Y2 (see FIG. 11B), and the bottom end thereof is supported by the bottom-side opening B of the container body 32Y1 via the bearing 32Y5. In addition, outside of the bearing 32Y5, a seal member 32Y7 and the shaft coupling 32Y6 are provided on the bottom side of the rotary shaft 32Y3*a* of the conveyance member 32Y3. The shaft coupling 32Y6 is fitted around the rotary shaft 32Y3*a* of the conveyance member 32Y3, and the shaft coupling 32Y6 and the conveyance member 32Y3 rotate together.

As described above, in the present embodiment, the blades 32Y3*b* of the conveyance member 32Y3 are formed of a soft material that is flexible, such that, when the blades 32Y3*b* slidingly contact the inner surface of the toner container 32Y, the load resistance can be alleviated, and the damage to the conveyed toner can be decreased. It is to be noted that the arrangement, number, and formation of the blades 32Y3*b* of the conveyance member 32Y3 are not limited to the configuration shown FIGS. 7, 10 and 11A.

Herein, in one comparative example, a toner container is formed by a container body and a cap member. More specifically, the container body rotates in a predetermined direction, and spiral protrusions are formed in an inner face of the container body. The cap that is not rotatable is held in an image forming apparatus. The cap is attached to a top side of the container body via a seal member. In this example, when the toner container hits something or is dropped due to careless handling, a gap is instantaneously caused in a seal member between the cap member and the container body, and accordingly the toner may leak through the gap.

By contrast, in the toner container 32Y according to the present embodiment, as described above, the container body 32Y1 and the flange member 32Y2 are firmly bonded together, and therefore, this problem can be prevented.

Next, another feature and operation of the toner container 32Y according to the present embodiment is described below.

Figure 12:
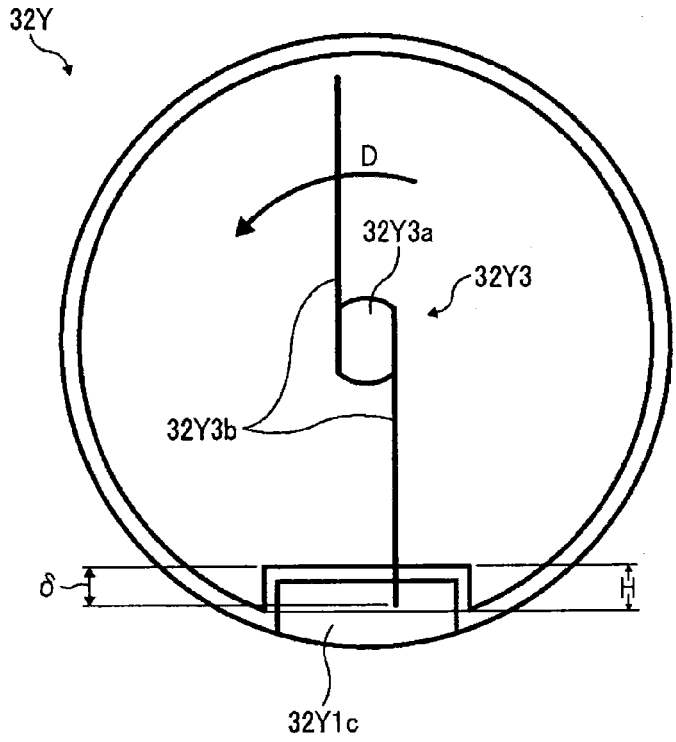
FIG. 12 is a cross section view illustrating the toner container shown in FIG. 8 in a portion where amounting section is positioned.

FIG. 12 is a cross section view illustrating the toner container 32Y in a portion where the mounting section 32Y1*c* is positioned. In FIG. 12, the mounting section 32Y1*c* is formed in the container body 32Y1 of the toner container 32Y and is the recessed portion projecting from the inner surface of the container body 32Y1 inward for a height H (In addition, the mounting section 32Y1*c* also functions a recessed portion viewed from outside). As described above, because the RFID 32Y10 is buried in the mounting section 32Y1*c* dented from the outer surface of the container body 32Y1, even when the user accidently hits the toner container 32Y against something or drops the toner container 32Y, the RFID 32Y10 can be less likely to be broken by hitting directly some objects or ground.

However, because the mounting section 32Y1*c* is the recessed portion that projects inward from the interior wall of the container body 32Y1, the mounting section 32Y1*c* may inhibit smooth flowing of the toner in the longitudinal direction of the toner container 32Y (direction from the bottom side to the top side, that is, a direction orthogonal to the surface of paper on which FIG. 12 is drawn). More specifically, the toner may be retained adjacent to the installation portion 32Y (recessed portion). When the toner is retained, that is, accumulates, near the installation portion 32Y, conveyance ability of the conveyance member 32Y3 in the toner container 32Y becomes weak. As a result, the amount of the toner to be discharged through the toner outlet W may become insufficient, and the retaining amount of the toner in the toner container 32Y is increased when the toner conveyance is completed.

In order to solve these problems, in the present embodiment, the projecting height H of the mounting section (recessed portion) 32Y1*c* is set to equal to or less than 5 mm ($H \leqq 5$ mm). When the experiment and simulation are executed to decide the projecting amount H, it was shown that the degree of retaining amount of the toner close to the mounting section 32Y1*c* could be almost ignored when the projecting amount H of the mounting section 32Y1*c* is equal to or less than 5 mm.

Further, with reference to FIG. 12, an amount δ by which the flexible blades 32Y3*b* of the conveyance member 32Y3 extend into an area of the mounting section (recessed portion) 32Y1*c* is set to equal to or less than 5 mm ($0\text{ mm} < \delta \leqq 5\text{ mm}$). The amount δ indicates the amount that, when it is assumed that the mounting section 32Y1*c* is not present in the toner container 32Y, the blades 32Y3*b* bite into the mounting section 32Y1*c*, that is, the blades 32Y3*b* overlap the position where the mounting section 32Y1*c* is supposed to be present. Accordingly, the blades 32Y3*b* actually contact the mounting section 32Y1*c* (hereinafter also recessed portion), and the blades 32Yb deform in accordance with the amount δ (hereinafter "deformation amount δ") shown in FIG. 12.

Since the blades 32Y3*b* bite into the recessed portion 32Y1*c*, the degree of fluidity of the toner accumulating close to the recessed portion 32Y1*c* can be enhanced, and the failures caused by the accumulated toner can be further alleviated.

It is important to note that if the deformation amount δ is over 5 mm, increases in a temperature in the outermost portion of the blades 32Y3*b* are excessively greater by sliding the blades 32Y3*b* against the recessed portion 32Y1*c*. If the end temperature is greatly increased, the toner positioned surrounding the blades 32Y3*b* is coagulated and is adhered. Then, the coagulated toner is supplied to the developing device 5Y, and the white void may be caused in an output image. Therefore, it is preferable that the deformation amount δ that the blades 32Y3*b* bite into the recessed portion 32Y1*c* be in a range from 0 mm to 5 mm ($0\text{ mm} < \delta \leqq 5\text{ mm}$).

In the present embodiment, the recessed portion in which the projecting height H and the deformation amount δ of the blades 32Y3*b* are restricted is adopted for the mounting section 32Y1*c* in which the RFID 32Y10 is set on the outer surface of the toner container 32Y. However, a recessed portion in which the projecting height H and the deformation amount δ of the blades 32Y3*b* are restricted is not limited to the mounting section 32Y1*c*. When there is another recessed portion (recessed portion viewed from outside) that projects inward from inner surface of the container body 32Y1 is present in the toner container 32Y, it is also necessary that the projecting height H and the deformation amount δ of the blades 32Y3*b* are restricted within above-described range in such a recessed portion. In other words, the depth of the recessed portion and the length of the blades are inversely related, and therefore can be varied within the above-described limits as necessary.

Next, a vicinity of the RFID 32Y10 is described below.

As described above, the RFID 32Y10, serving as an electronic data storage, is set in the mounting section 32Y1*c* (recessed portion) on the outer surface of the toner container 32Y without using adhesive or thermal welding.

Figure 13A:
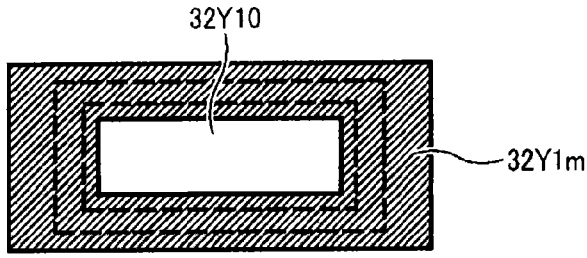
FIG. 13A is an enlarged top view illustrating the mounting section shown in FIG. 12 shown in FIG. 12 in which an electronic data storage is set.
Figure 13B:
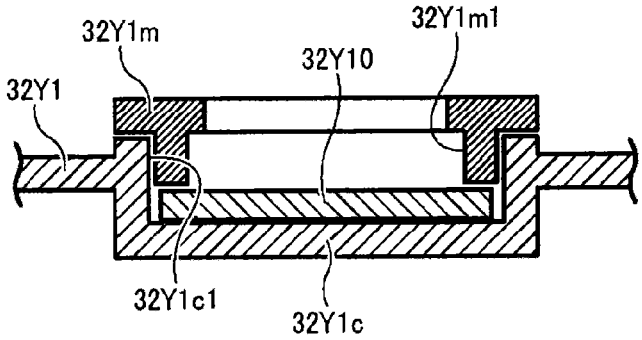
FIG. 13B is an enlarged section view illustrating the mounting section shown in FIG. 13A.

FIG. 13A is an enlarged top view illustrating the mounting section 32Y1*c* in which the RFID 32Y10 is set. FIG. 13B is an enlarged section view illustrating the mounting section 32Y1*c* in which the RFID 32Y10 is set.

With reference to FIGS. 13A and 13B, the RFID 32Y10 is set in the mounting section 32Y1*c* by a wall 32Y1*c*1 and a lid 32Y1*m* without using adhesive or thermal welding. The wall 32Y1*c*1, serving as a first restriction member, restricts movement of the RFID 32Y10 on the outer surface along with the outer surface of the toner container 32Y. The lid 32Y1*m*, serving as a second restriction member, restricts movement of the RFID 32Y10 in a direction perpendicular to the outer surface of the toner container 32Y. When the junction between the RFID 32Y10 and the lid 32Y1*m* is released, the RFID 32Y10 can be separated from the toner container 32Y. Thus, any particular jigs are not necessary for releasing.

More specifically, with reference to FIGS. 13A and 13B, the wall 32Y1*c*1 (the first restriction member) protrudes outward from outer surface of the container body 32Y1 to envelop the RFID 32Y10. The wall 32Y1*c*1 thus formed performs positioning the RFID 32Y10 in a surface direction along with the outer circumferential surface of the toner container 32Y (directions lateral in FIG. 13B and that orthogonal to the surface of paper on which FIG. 13B is drawn).

The lid 32Y1*m* (the second restriction member) includes a standing portion 32Y1*m*1 that fits into the inner face of the wall 32Y1*c*1. The standing portion 32Y1*m*1 contacts the RFID 32Y10 to cover an upper surface of the RFID 32Y10 partially.

In this configuration, because an opening is formed in the lid 32Y1*m*, when the lid 32Y1*m* is attached to the mounting section 32Y1*c*, the upper surface of the RFID 32Y10 can be exposed from outside. Thus, the lid 32Y1*m* performs positioning the RFID 32Y10 in the direction perpendicular to the outer surface (outer circumferential surface) of the toner container 32Y (in a direction vertical to the surface of paper on which FIG. 13B is drawn).

Herein, the standing portion 32Y1*m*1 of the lid 32Y1*m* and the wall 32Y1*c*1 of the container body 32Y1 are dimensioned so that the standing portion 32Y1*m*1 can favorably fit into the wall 32Y1*c*1. Accordingly, even when a relatively great external force exerts on the toner container 32Y, failure that the lid 32Y1*c* easily drops out from the mounting section 32Y1*c* and RFID 32Y10 drops out together can be prevented.

Figure 14:
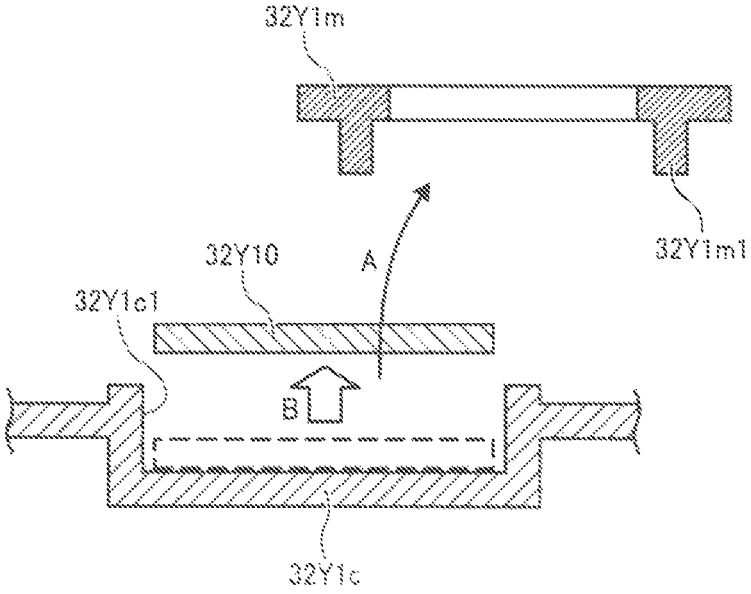
FIG. 14 is an enlarged section view showing a releasing process of the electronic data storage from mounting section shown in FIGS. 13A and 13B.

Moreover, as shown in FIG. 14, when the lid 32Y1*m* is separated from the wall 32Y1*c*1 in a direction indicated by arrow A shown in FIG. 14 and the junction between the RFID 32Y10 and the lid 32Y1*m* is released, the RFID 32Y10 can be easily separated from the toner container 32Y in a direction indicated by arrow B shown in FIG. 14.

As a result, the RFID 32Y10 can be easily and effectively separated from the toner container 32Y during recycling.

More specifically, when the container body 32Y1 of the toner container 32Y is recycled, it is necessary to remove the residual toner in the container body 32Y1 with water or air. At this time, the RIFD 32Y10 may be damaged by the water or air if the RFID 32Y10 is set in the mounting section 32Y1*c* of the toner container 32Y. Therefore, it is necessary to separate the RFID 32Y10 from the toner container 32Y before the container body 32Y1 of the toner container 32Y is washed. Then, the RFID 32Y10 that is inputted with new data again is set in the container body 32Y1 after washing.

Alternatively, when the container body 32Y1 of the toner container 32Y is recycled, it is necessary to separate the RFID 32Y10 from the toner container 32Y because the material forming RFID 32Y10 is different from that of the container body 32Y1. Then, the separated RFID 32Y10 is reset and recycled.

In the present embodiment, the RFID 32Y10 can be easily attached to and detached from the toner container 32Y without using adhesive or thermal welding. Therefore, in manufacturing the toner container 32Y the work of attaching the RFID 32Y10 to the toner container 32Y can be facilitated. Further, during maintenance of the toner container 32Y, the RFID 32Y10 attached to the toner container 32Y can be easily replaced with a new one.

In the present embodiment, with reference to FIGS. 8 and 9, the RFID 32Y10 is positioned in the recessed portion 32Y1*c* projecting inward from outer surface of the container body 32Y1, and is positioned close to the toner outlet W, by the wall 32Y1*c*1 (first restriction member) and the lid 32Y1*m* (second restriction member) shown in FIGS. 13A and 13B.

Figure 15:
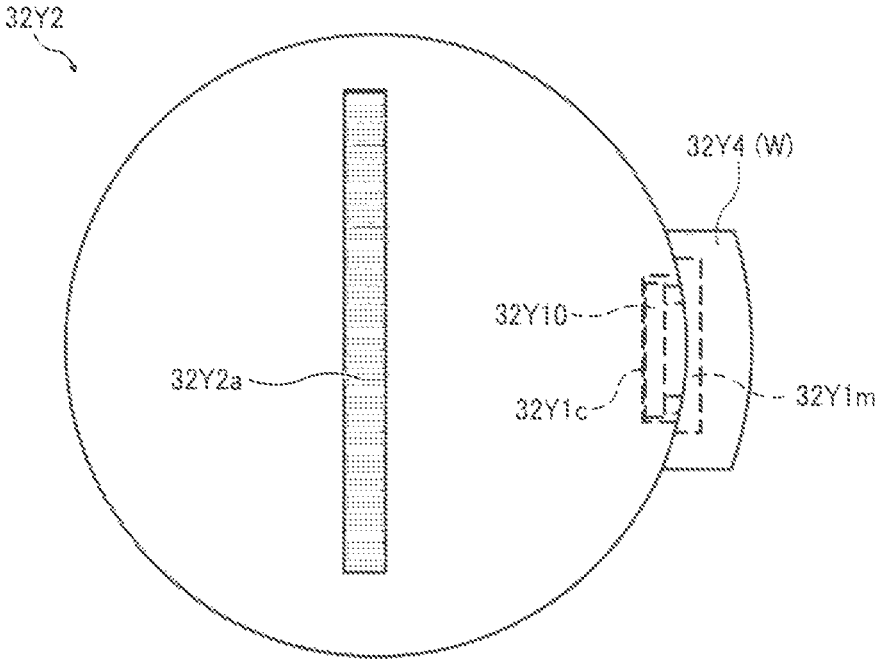
FIG. 15 is a diagram illustrating the toner container shown in FIG. 8, viewed from a longitudinal direction of the toner container on the flange member side.

As shown in FIG. 15, the RFID 32Y10, the wall 32Y1*c*1, and the lid 32Y1*m* are arranged in a projected area of the flange member 32Y2 when the shutter member 32Y4 covers the toner outlet W viewed from the flange member 32Y2 side to the container body 32Y1. In the other words, when the shutter member 34 closes the toner outlet W, the RFID 32Y10 is positioned in the recessed area of the toner container 32Y including the shutter member 32Y4 viewed from longitudinal direction of the toner container 32Y. Therefore, even when the user hits the toner container 32Y against something or drops the toner container 32Y, the shutter member 32Y4 is more likely to hit against the object or ground directly, and then the RFID 32Y10 is less likely to receive damage directly and be broken.

As described above, in the present embodiment of the toner container 32Y that includes the conveyance member 32Y3 to convey the toner in the container body 32Y1 to the toner outlet W in the longitudinal direction, although the mounting section 32Y1*c* (recessed portion) projecting inward from the inner surface of the toner container 32Y is formed in the toner container 32Y, failures such as accumulation of toner around the recessed portion can be alleviated.

In addition, in the present embodiment, in the toner container 32Y containing the RFID 32Y10 as the electronic data storage, the RFID 32Y10 can be effectively collected from and set again in the toner container 32Y during the recycle processing.

Second Embodiment

Next, mounting sections according to a second embodiment is described with reference to FIGS. 16-A1 through 16-E2.

FIGS. 16-A1 through 16-E2 are enlarged view illustrating mounting section 32Y1*c*-A, 32Y1*c*-B, 32Y1*c*-C, 32Y1*c*-D, and 32Y1*c*-E in which the RFID 32Y10 is set and correspond to FIGS. 13A and 13B regarding the first embodiment. It is to be noted that the toner container to which the mounting section 32Y1*c*-A, 32Y1*c*-B, 32Y1*c*-C, 32Y1*c*-D, or 32Y1*c*-E is applicable to is hereinafter referred to as a toner container 32Y-α.

The configuration of mounting sections 32Y1*c*-A, 32Y1*c*-B, 32Y1*c*-C, 32Y1*c*-D, and 32Y1*c*-E are difference from the mounting section 32Y1*c*.

Similarly to the configuration of the toner container 32Y in the first embodiment, in the present embodiment, the toner container 32Y-α also includes a container body 32Y1, the flange member 32Y2, the conveyance member 32Y3, and the shutter member 32Y4, and the RFID 32Y10 is detachably attached therein.

Further, the RFID 32Y10 is set in any of the mounting sections 32Y1*c*-A, 32Y1*c*-B, 32Y1*c*-C, 32Y1*c*-D, and 32Y1*c*-E by a first restriction member to restrict movement of the RFID 32Y10 on the outer surface along with the outer surface of the toner container 32Y-α and a second restriction member to restrict movement of the RFID 32Y10 in a direction perpendicular to the outer surface of the toner container 32Y-α, without using adhesive or thermal welding. When the junction between the RFID 32Y10 and the first restriction member or the second restriction member is released, the RFID 32Y10 can be separated from the toner container 32Y-α, without using special jigs.

In addition, the projecting height H of any of the mounting sections (recessed portion) 32Y1*c*-A, 32Y1*c*-B, 32Y1*c*-C, 32Y1*c*-D, and 32Y1*c*-E is set to equal to or less than 5 mm ($H \leqq 5$ mm), and the deformation amount δ by which the flexible blades 32Y3*b* of the conveyance member 32Y3 extend into an area of the each of mounting sections (recessed portions) 32Y1*c*-A, 32Y1*c*-B, 32Y1*c*-C, 32Y1*c*-D, and 32Y1*c*-E is set to equal to or less than 5 mm ($0 \text{ mm} < \delta \leqq 5$ mm).

However, in the mounting sections (recessed portion) 32Y1*c*-A, 32Y1*c*-B, 32Y1*c*-C, 32Y1*c*-D, and 32Y1*c*-E according to the present embodiment, the structure of the first restriction member and the second restriction member is different from the structures thereof according to the first embodiment.

Herein, five structures, shown in FIGS. 16-A1 and 16-A2, FIGS. 16-B1 and 16-B2, FIGS. 16-C1 and 16-C2, FIGS. 16-D1 and 16-D2, and FIGS. 16-E1 and 16-E2 are described below.

In the mounting section 32Y1*c*-A shown in FIGS. 16-A1 and 16-A2, a wall 32Y1*c*1-A, serving as the first restriction member, is almost similar configuration to the wall 32Y1*c*1 shown in FIG. 13A. A lid 32Y1*m*-A, serving as the second restriction member, has a standing portion to engage an outer face of a wall 32Y1*c*1-A. The RFID 32Y10 is set in position in a direction perpendicular to the outer surface (outer circumferential direction) of the toner container 32Y-α1 by the lid 32Y1*m*-A.

In the toner container 32Y-α2 shown in FIGS. 16-B1 and 16-B2, a wall 32Y1*c*1-B, serving as the first restriction member, is almost similar configuration to the wall 32Y1*c* shown in FIG. 13A. A lid 32Y1*m*-B, serving as the second restriction member, is bonded to the wall 32Y1*c*1-B by gluing at a position indicated by a circle NZ shown in FIG. 16-B2.

The RFID 32Y10 is set to be positioned in a perpendicular to the direction in the outer surface direction (outer circumference direction) of the toner container 32Y-α2 by the lid 32Y1*m*-B. In this construction, the adhesive has a certain degree of adhesion force so that the lid 32Y1*m*-B does not drop but can be borne to the wall 32Y1*c*-B even when a relatively great force exerts on the lid 32Y1*m*-B and that the lid 32Y1*m*-B can be easily separated from the wall 32Y1*c*1-B when the toner container 32Y-α2 is recycled.

The mounting section 32Y1*c*-C shown in FIGS. 16-C1 and 16-C2 includes multiple boss members 32Y1*c*2 protrude outward from the outer surface of the toner container 32Y, and multiple holes 32Y10*a* are formed in a RFID 32Y10-C. When the RFID 32Y10-C is set in the toner container 32Y-α3, the multiple boss members 32Y1*c*2 inserts into the hole 32Y10*a* of the RFID 32Y10-C. Thus, the RFID 32Y10-C is set to be positioned in along direction in the outer surface direction (outer circumference direction) of the toner container 32Y-α3 by the multiple boss members 32Y1*c*2. The mounting section 32Y1*c*-C further includes multiple hook members 32Y1*c*3, serving as the second restriction member, protruding outward from the outer face of the mounting section 32Y1*c*. The multiple hooks 32Y1*c*3 engage a part of a top face of the RFID 32Y10-C. Thus, the RFID 32Y10-C is set to be positioned in a perpendicular to the direction in the outer surface direction (outer circumference direction) of the toner container 32Y-α3 by the multiple hook members 32Y1*c*3.

Then, when the engagement between the RFID 32Y10-C and the hook member 32Y1*c*3 are released by deforming elastically the hook member 32Y1*c*3, the 32Y10-C can be easily separated from the toner container 32Y-α3.

In a toner container 32Y-α4 shown in FIGS. 16-D1 and 16-D2, an installation holder 32Y1*n* that is detachably attached to the mounting section 32Y1*c*-D (recessed portion) functions as the first restriction member and the second restriction member.

The installation holder 32Y1*n* is formed of a resign that is relatively flexible, and recessed portions are formed in the installation holder 32Y1*n* to hold four corners of the RFID 32Y10.

The installation holder 32Y1*n* can be easily attached to and detached from the mounting section 32Y1*c*-D by bending the installation holder 32Y1*n* removed from the mounting section 32Y1*c*-D. Further, the installation holder 32Y1*n* engages the mounting section 32Y1*c*-D at an engagement position indicated as a broken line circle Q1 shown in FIG. 16-D2, which determines the position of the RFID 32Y10 in the installation holder 32Y1*n* to the mounting section 32Y1*c*-D in the directions along the outer face of the container body 32Y1-α4 and the perpendicular direction of the outer face of the container body 32Y1-α4.

Then, after the installation holder 32Y1*n* is detached from the mounting section 32Y1*c*-D (recessed portion), the engagement between the RFID 32Y10 and the installation holder 32Y1*n* is released by bending elastically the installation holder 32Y1*n*, and therefore, the RFID 32Y10 can be easily separated from the toner container 32Y-α4.

In a toner container 32Y-α5 shown in FIGS. 16-E1 and 16-E2, an installation holder 32Y1*n*-E functions as the first restriction member and the second restriction member, similarly to the installation holder 32Y1*n* shown in FIGS. 16-D1 and 16-D2.

In this structure, an engagement opening is opened in the container body 32Y1-α5 into which the installation holder 32Y1*n*-E is inserted. Therefore, the engagement opening of the container body 32Y1-α5 is sealed by inserting the installation holder 32Y1*n*-E, and the inserted installation holder 32Y1*n*-E also functions as a projection portion (mounting section 32Y1*c*-E). The position of the installation holder 321*n*-E is determined in directions parallel and perpendicular to the outer face of the container body 32Y1-α5 by engaging the installation holder 321*n*-E with the container body 32Y1-α at an engagement position Q2 shown in FIG. 16-E2.

Then, after the installation holder 32Y1*n*-E is detached from the container body 32Y1-α5, the engagement between the RFID 32Y10 and the installation holder 32Y1*n*-E is released by bending elastically the installation holder 32Y1*n*-E, and therefore, the RFID 32Y10 can be easily separated from the toner container 32Y-α5.

As described above, in the second embodiment, similarly to the first embodiment, in the toner container 32Y-α including the conveyance member 32Y3 to convey the toner in the container body 32Y1-α to the toner outlet W in the longitudinal direction, when the projection portion 32Y1*c* (mounting section) that projects inward from the inner face of the toner container 32Y-α are provided, failures such as accumulation of toner around the recessed portion can be alleviated.

In addition, similarly to the first embodiment, in the toner container 32Y-α containing the RFID 32Y10 as the electronic data storage, the RFID 32Y10 can be effectively collected from and set again to the toner container 32Y-α during the recycle processing, and therefore, workability in the recycle processing of the toner container 32Y-α can be secured.

Third Embodiment

Next, a third embodiment is described with reference to FIGS. 17A.

FIG. 17A is a cross section view illustrating a toner container 32Y-β according to the third embodiment. FIG. 17B is a schematic diagram illustrating the schematic perspective view illustrating another toner container 32Y-ç.

The difference between the toner container 32Y and the toner container 32Y-β is that a toner inlet KR is formed in one end of a flange member 32Y2-β of the toner container 32Y-β.

Similarly to the configuration of the toner container 32Y in the first embodiment, in the present embodiment, the toner container 32Y-β includes the toner container body 32Y1, the flange member 32Y2-β, a conveyance member 32Y3, and a shutter member 32Y4, and the RFID 32Y10, serving as the electronic data storage, is detachably installed in the toner container 32Y-β.

Further, the RFID 32Y10 is set in the mounting section 32Y1*c* by a first restriction member to restricts movement of the RFID 32Y10 on the outer surface along with the outer surface of the toner container 32Y-β and a second restriction member to restrict movement of the RFID 32Y10 in a direction perpendicular to the outer surface of the toner container 32Y-β, without using adhesive or thermal welding. When the junction between the RFID 32Y10 and the first restriction member or the second restriction member is released, the RFID 32Y10 can be separated from the toner container 32Y-β, without using special jigs.

In addition, the projecting height H of the mounting section (recessed portion) 32Y1*c* is set to equal to or less than 5 mm (H≦5 mm), and the deformation amount δ by which the flexible blades 32Y3*b* of the conveyance member 32Y3 extend into an area of the mounting section (recessed portion) 32Y1*c* is set to equal to or less than 5 mm (0 mm<δ≦5 mm).

As shown in FIGS. 17A and 17B, the toner inlet KR through which the toner is put into the toner container 32Y-β and 32Y-ç is formed in the one end of the flange member 32Y2-β. Further, a cap 32Y2*c*, serving as a seal member to cover the toner inlet KR, is detachably attached to the flange member 32Y2-β. In this embodiment, because the toner inlet KR is formed in the end of the flange member 32Y2-β, the toner can be put in the toner container 32Y-β and 32Y-ç through the toner inlet KR in a state in which the longitudinal side of the toner container 32Y-β and 32Y-ç is disposed vertically, making it easier to fill the toner container 32Y-β with toner in the manufacturing process. Then, after filling the toner container 32Y-β and 32Y-ç with toner, the cap 32Y2*c* is attached to the toner inlet KR. Accordingly, the toner can be prevented from leaking from the toner inlet KR.

In addition, when the toner container 32Y-β and 32Y-ç is recycled, the cap 32Y2*c* is separated from the filling inlet KR. Then, the toner container 32Y-β is cleaned and toner is put in the toner container 32Y-β and 32Y-ç.

In the embodiment of FIG. 17B, a concave portion 32Y2*a*10 is formed in the handle part 32Y2*a* so that the handle part 32Y2*a* does not obstruct attachment and detachment of the cap 32Y2*c* to the toner inlet KR and toner supply from outside to the toner container 32Y-β and 32Y-ç through the toner inlet KR. Specifically, as shown in FIG. 17B, the concave portion 32Y2*a*10 overlaps the toner inlet KR when viewed from the longitudinal direction.

Further, in the embodiment of FIG. 17B, the flange member 32Y2-β is attached to the container body 32Y1 without gluing or thermally welding. A contact portion (an area S shown in FIG. 17B) between the flange member 32Y2-β and the container body 32Y1 is covered with adhesive tape partially or entirely from outside.

In this configuration, when the toner container 32Y-β is recycled, and flange member 32Y2-β is required to be separated from the container body 32Y1 (for example, the flange member 32Y2-β is replaced with a new one), the disassembly operation can be effectively executed.

In addition, in embodiment of FIG. 17B, similarly to the first embodiment, in the toner container 32Y-β and 32Y-ç including the conveyance member 32Y3 to convey the toner in the container body 32Y1 to the toner outlet W in the longitudinal direction, when the projection portion 32Y1*c* (mounting section) that projects inward from the inner face of the toner container 32Y-β and 32Y-ç are provided, failures such as accumulation of the toner around the recessed portion can be alleviated.

In addition, similarly to the first embodiment, in the toner container 32Y-α containing the RFID 32Y10 as the electronic data storage, the RFID 32Y10 can be effectively collected from and set again to the toner container 32Y-α during the recycle processing, and therefore, workability in the recycle processing of the toner container 32Y-α can be secured.

Fourth Embodiment

Next, a fourth embodiment is described below with reference to FIGS. 18-A1 through 22.

The toner containers 32Y-γ according to the fourth embodiment is different from the toner container 32Y according to the first embodiment in that a container body 32Y1-γ of the toner containers 32Y-γ can be divided into two, and then split container halves 32Y1A and 321B are joined together during assembling. It is to be noted that hereinafter the toner 32Y-γ, 32Y-γ1, and 32Y-γ2 may be collectively referred to as "toner containers 32Y-γ" when discrimination therebetween is not necessary.

FIG. 18-A1 is a schematic front view illustrating a container body 32Y1-γ of a toner container 32Y-γ before assembling. FIG. 18-A2 is a side view illustrating the container body 32Y1-γ shown in FIG. 18-A1. FIG. 18-B1 is a schematic front view illustrating the container body 32Y1-γ of the toner container 32Y-γ shown in FIG. 19 after assembling. FIG. 18-B2 is a side view illustrating the container body 32Y1-γ shown in FIG. 18-B1.

Figure 19:
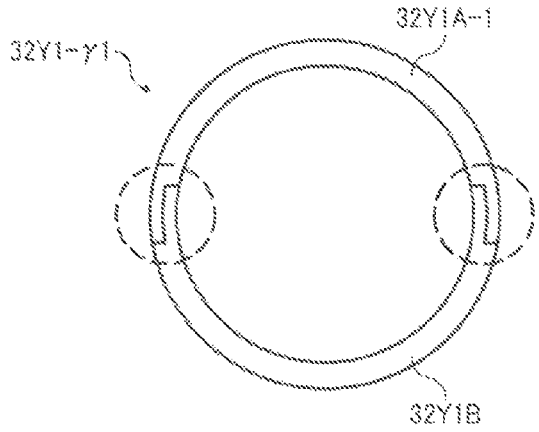
FIG. 19 is a front view illustrating a container body, which is a variation of the fourth embodiment after assembling.
Figure 20A:
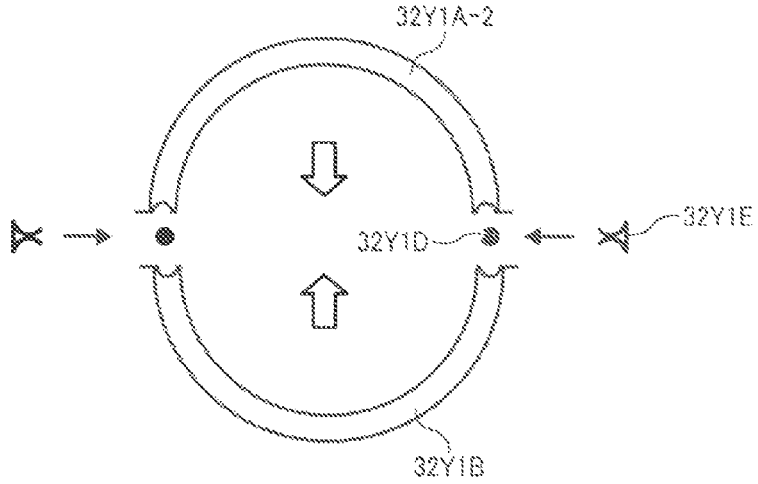
FIG. 20A is a front view illustrating a container body, which is another variation of the present embodiment before assembling.
Figure 20B:
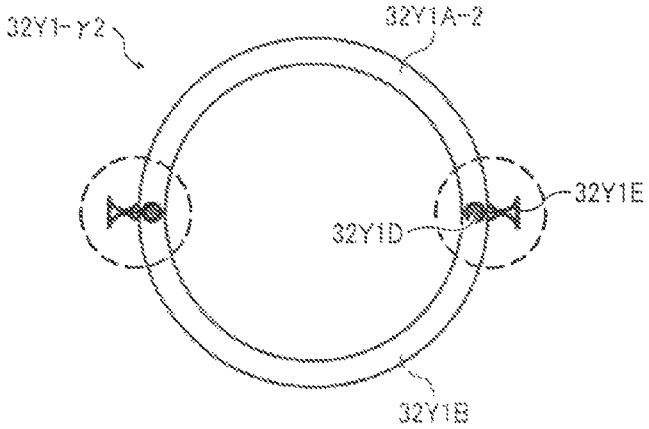
FIG. 20B is a schematic front view illustrating the container body shown in FIG. 20A after assembling.
Figure 21:
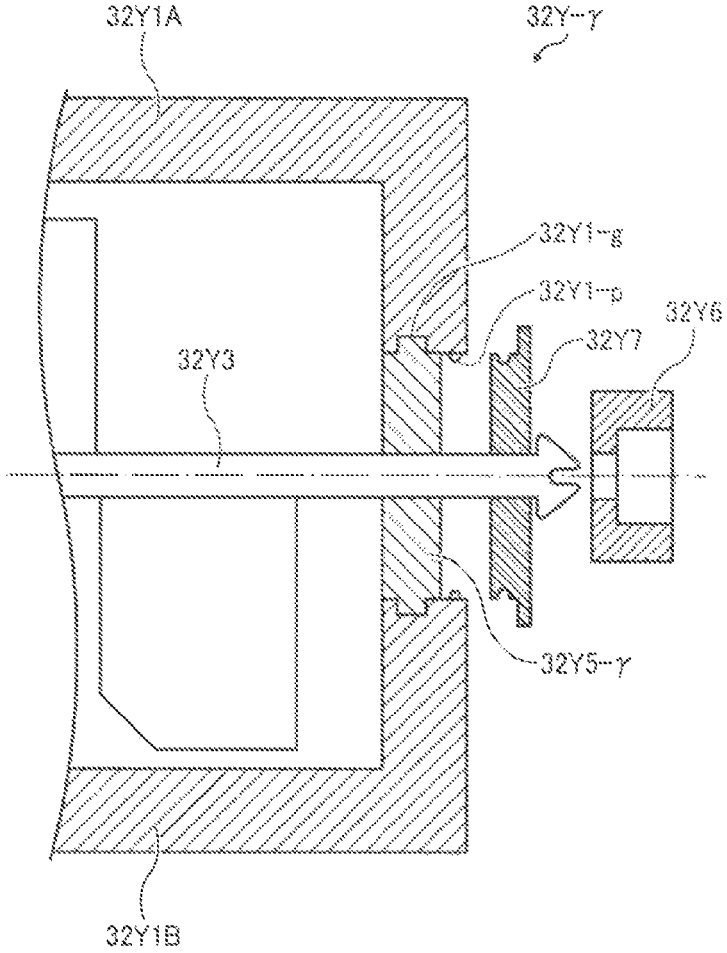
FIG. 21 is a cross section view illustrating a vicinity of the bottom side of the toner containers shown in FIGS. 18-A1 through 20B cut along the longitudinal direction.
Figure 22:
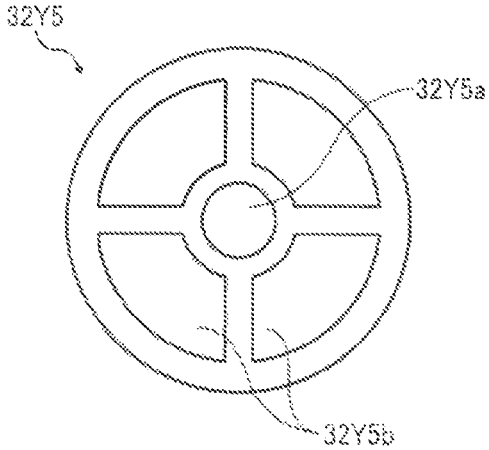
FIG. 22 is a front view illustrating a bearing included in the toner containers shown in FIG. 21.

FIG. 19 is a front view illustrating a container body 32Y1-γ1, which is a variation of the present embodiment after assembling. FIG. 20A is a front view illustrating a container body 32Y1-γ2, which is another variation of the present embodiment before assembling. FIG. 20B is a schematic front view illustrating the container body 32Y1-γ2 shown in FIG. 20A after assembling. FIG. 21 is across section view illustrating a vicinity of the bottom side of the toner container 32Y-γ, 32Y-γ1, or 32Y-γ2 cut along the longitudinal direction. FIG. 22 is a front view illustrating a bearing 32Y5-γ.

Similarly the configuration of the toner container 32Y in the first embodiment, in the present embodiment, the toner container 32Y-γ the toner container 32Y-γ also include the container body 32Y1-γ, the flange member 32Y2, the conveyance member 32Y3, and the shutter member 32Y4, and the RFID 32Y10 is detachably installed therein.

Further, the RFID 32Y10 is set in the mounting section 32Y1*c* by a first restriction member to restricts movement of the RFID 32Y10 on the outer surface along with the outer surface of the toner container 32Y-γ and a second restriction member to restrict movement of the RFID 32Y10 in a direction perpendicular to the outer surface of the toner container 32Y-γ, without using adhesive or thermal welding. When the junction between the RFID 32Y10 and the first restriction member or the second restriction member is released, the RFID 32Y10 can be separated from the toner container 32Y-γ, without using special jigs.

In addition, the projecting height H of the mounting section (recessed portion) 32Y1*c* is set to equal to or less than 5 mm (H≦5 mm), and the deformation amount δ by which the flexible blades 32Y3*b* of the conveyance member 32Y3 extend into an area of the mounting section (recessed portion) 32Y1*c* is set to equal to or less than 5 mm (0 mm<δ5 mm).

Herein, as shown in FIGS. 18-A1 and 18-B2, the container body 32Y1-γ is manufactured by gluing or welding together two halves of the container, first and second split container halves 32Y1A and 32Y1B. More specifically, the first split container half 32Y1A and the second split container half 32Y1B are formed separately, and the first split container half 32Y1A and the second split container half 32Y1B are moved in directions indicated by arrows shown in FIGS. 18-A1 and 18-A2. Then, as shown in FIG. 18-B1 and 18-B2, both the first split container half 32Y1A and the second split container half 32Y1B are aligned with each other, after which, a contact portions indicated by a broken line circle shown in FIG. 18-B1 are joined by gluing or thermally welding.

As described above, because the container body 32Y1-γ is formed of two container parts divided in a circumferential direction, the respective split container halves 32Y1A and 32Y1-B can be formed by injection molding. Therefore, even if the container body 32Y1-γ has a relatively complicated shape with projections and recesses, the complicated shape can be formed easily. In addition, the conveyance member 32Y3 can be set in the container body 32Y1-γ simultaneously with joint of the split container halves 32Y1A and 32Y1B, and accordingly, workability in assembling can be enhanced As a variation of the fourth embodiment, in the container body 32Y1-γ1 shown in FIG. 19, split container halves 32Y1A-1 and 32Y1B-1 are joined so that connection portions between the split container halves 32Y1A-1 and 32Y1B-1 indicated by broken line circles shown in FIG. 19 do not protrude outward. In this case, similarly to the configuration shown in FIGS. 18-A1 and 18-B2, same effect in the toner container 32Y-γ1 can be attained.

As another variation of the fourth embodiment, in the container body 32Y1-γ2 shown in FIGS. 20A and 20B, split container halves 32Y1A-2 and 32Y1B-2 are joined with a seal member 32Y1D sandwiched therebetween and are detachably fixed by a fixing member (clip) 32Y1E. In this configuration, by detaching the fixing member (clip) 32Y1E, the split container halves 32Y1A-2 and 32Y1B-2 can be separated easily from each other. Therefore, when the container body 32Y1-γ formed of the split container halves 32Y1A and 32Y1B is recycled, workability in cleaning in the toner container 32Y-γ can be enhanced.

Herein, with reference to FIG. 21, semicircle grooves 32Y1-*g* is engraved on the bottom face of each of the split container halves 32Y1A, 32Y1B, 32Y1A-1, 32Y1B-1, 32Y1A-2, and 32Y1B-2 according to the present embodiment so as to sandwich and fix a bearing 32Y5-γ, and semicircle protrusions 32Y1-*p* are formed in each of them to sandwich and fix the seal member 32Y7. The semicircle groove 32Y1-*g* and the semicircle protrusion 32Y1-*p* in the split container half 32Y1A are symmetrical to those in the split container half 32Y1B. It is to be noted that, although the split container halves 32Y1A and 32Y1B are illustrated in FIG. 21, the split container halves 32Y1A-1, 32Y1A-2, 32Y1B-1, and 32Y1B-2 have similar configurations.

More specifically, in the above-described fourth embodiment including several variations, the bearing 32Y5-γ has four radial holes 32Y5*b* in addition to a central hole 32Y5*a* through which the shaft 32Y3*a* of the conveyance member 32Y3 is inserted so that the toner is put in the container body 32Y1-γ through the radical holes 32Y5*b*.

In a manufacturing process of the toner container 32Y-γ, after the toner container 32Y-γ is assembled, the toner is put in the container body 32Y1-γ via the radial holes 32Y5*b*, serving as a toner inlet.

As described above, because the toner inlet 32Y5*b* is formed in the bottom face of the toner container 32Y-γ, while the longitudinal side of the toner container 32Y-γ is kept vertical, (while the toner container 32Y-γ is placed with bottom side up), the toner can be put in the toner container 32Y-γ via the toner inlet 32Y5*b* placed in an upper portion. Then, after the filling process in the toner container 32Y-γ is completed, in order to seal the toner inlet 32Y5*b*, the seal member 32Y7 is set to closely contact around the bearing 32Y5-γ, and therefore, the leakage of the toner from the toner inlet 32Y5*b* can be prevented.

As described above, in the toner container 32Y-γ including the conveyance member 32Y3 to convey the toner in the container body 32Y1-γ to the toner outlet W in the longitudinal direction, when the projection portion 32Y1*c* (mounting section) that projects inward from the inner face of the toner container 32Y-γ are provided, failures such as accumulation of toner around the recessed portion can be alleviated.

In addition, similarly to the first embodiment, in the toner container 32Y-γ containing the RFID 32Y10 as the electronic data storage, the RFID 32Y10 can be effectively collected from and set again to the toner container 32Y-α during the recycle processing, and therefore, workability in the recycle processing of the toner container the toner container 32Y-α can be secured.

Fifth Embodiment

Next, a fifth embodiment is described with reference to FIGS. 23 through 24B.

In the toner container 32Y-ϵ according to the present embodiment, an opening (a second opening) L is formed on a bottom side of the container body 32Y1-ϵ and a second flange member 32Y20 covers the opening L. The difference between the toner container 32Y-ϵ according to the present embodiment and the toner container 32Y according to the first embodiment is that the toner container 32Y-ϵ according to the fifth embodiment has two flange members 32Y2 and 32Y20.

Figure 23:
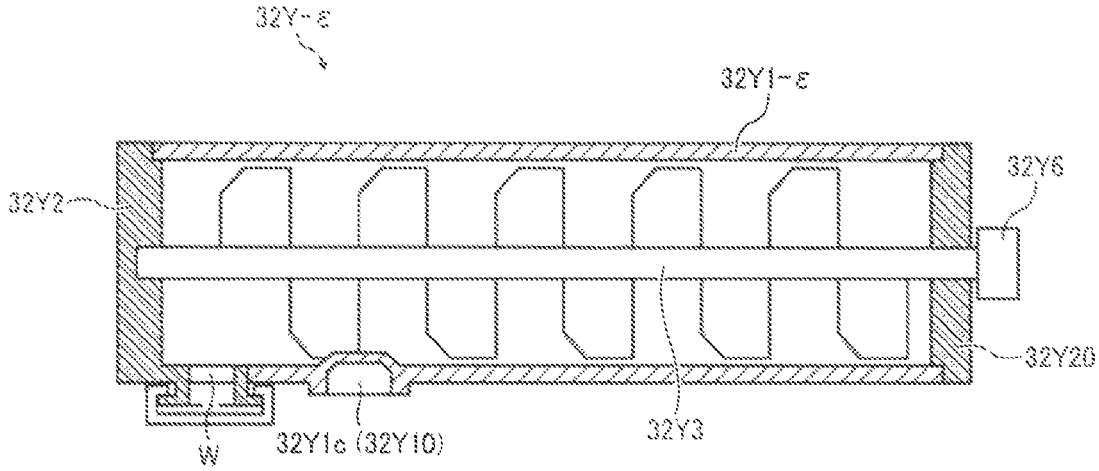
FIG. 23 is a schematic cross section view illustrating a toner container according to a fifth illustrative embodiment.
Figure 24A:
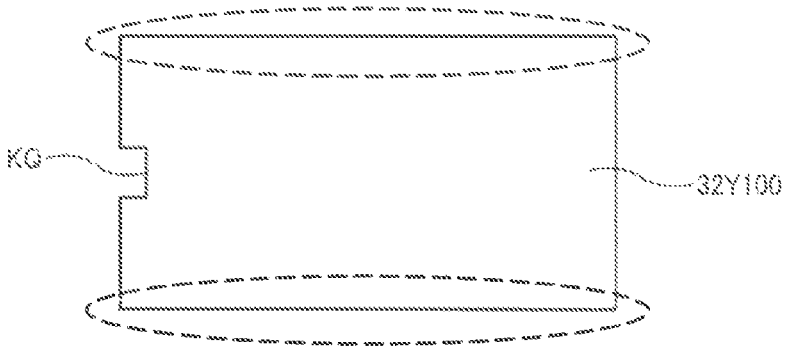
FIG. 24A is a plan view illustrating a variation of a container body of a toner container shown in FIG. 23, a container body, before assembling.

FIG. 23 is a schematic cross section view illustrating a toner container 32Y-ϵ according to the fifth embodiment. FIG. 24A is a plan view illustrating a variation of the toner container 32Y-ϵ, a container body 32Y1-ϵ1, before assembling. FIG. 24B is a perspective view illustrating the container body 32Y1-ϵ1 shown in FIG. 24A after assembling.

Similarly to the configuration of the toner container 32Y in the first embodiment, in the present embodiment, the toner container 32Y-ϵ also include the container body 32Y1-ϵ, the flange member 32Y2, the conveyance member 32Y3, and the shutter member 32Y4, and the RFID 32Y10 is detachably attached therein.

Further, the RFID 32Y10 is set in the mounting section 32Y1*c* by a first restriction member to restricts movement of the RFID 32Y10 on the outer surface along with the outer surface of the toner container 32Y-ϵ and a second restriction member to restrict movement of the RFID 32Y10 in a direction perpendicular to the outer surface of the toner container 32Y-ϵ, without using adhesive or thermal welding. When the junction between the RFID 32Y10 and the first restriction member or the second restriction member is released, the RFID 32Y10 can be separated from the toner container 32Y-ϵ, without using special jigs.

In addition, the projecting height H of the mounting section (recessed portion) 32Y1*c* is set to equal to or less than 5 mm ($H \leqq 5$ mm), and the deformation amount δ by which the flexible blades 32Y3*b* of the conveyance member 32Y3 extend into an area of the mounting section (recessed portion) 32Y1*c* is set to equal to or less than 5 mm ($0\ \text{mm} < \delta \leqq 5$ mm).

Herein, different from the toner container 32Y according to the first embodiment, in the toner container 32Y-ϵ, a second opening L is formed on the bottom side of the container body 32Y1-ϵ instead of the opening B.

The opening B according to the first embodiment opens only a center portion of the bottle face of the container body 32Y1-ϵ. By contrast, the opening L according to the fifth embodiment opens entire bottom face of the container body 32Y1-ϵ, and the opening L is formed in formed in the bottom end of the container body 32Y1-ϵ so that the container body 32Y1-ϵ j fits into the second flange member 32Y20 in which the bearing 32Y5-ϵ to bear the bottom side of the conveyance member 32Y3 is set. The opening L serves as a second opening.

In the toner container 32Y-ϵ, the flange member 32Y is firmly attached to the container body 32Y1-ϵ is, and the second flange member 32Y10 is also firmly attached to the container body 32Y1-ϵ. Therefore, if the toner container 32Y-ϵ hits somewhere or dropped due to careless handling of the user, the failure that the toner leak or from connection portions between the container body 32Y1-ϵ and the flange member 32Y2 and between the container body 32Y1-ϵ and the second flange member 32Y20 can be prevented.

Figure 24B:
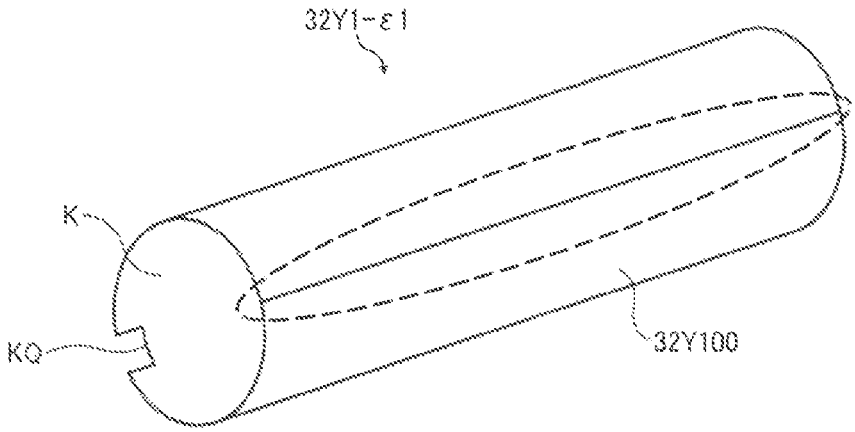
FIG. 24B is a perspective view illustrating the container body shown in FIG. 24A after assembling.

In addition, in the toner container 32Y-ϵ, the container body 32Y1-ϵ can be formed from a sheet of film member 32Y100 with reference to FIGS. 24A and 24B. More specifically, as shown in FIG. 24A, initially, the film member 32Y100 is formed from an almost rectangular shaped film including the notch KQ. Subsequently, the film member 32Y100 is rolled into a cylinder so that both edge portion (indicated by broken line cycles in FIGS. 24A and 24B) face each other, and the facing end portions are joined together. Accordingly, inexpensive cylindrical container body 32Y1-ϵ can be formed. Then, the cylindrical container body 32Y1-ϵ engages respective flange members 32Y2 and 32Y20 so that the openings K contacts the flange member 32Y2 and the opening L contacts the flange member 32Y20, and thus, the toner container 32Y-ϵ, similarly to the toner container 32Y-ϵ shown in FIG. 23, can be formed.

It is to be noted that when the container body 32Y1-ϵ is formed from the film member 32Y100, it may be difficult to form the mounting section 32Y1*c*, recessed from the outer circumferential surface, on the outer surface of the container body 32Y1-ϵ1. Accordingly, in this case, the recessed mounting section is formed on the flange member 32Y2.

As described above, in the toner container 32Y-ϵ including the conveyance member 32Y3 to convey the toner in the container body 32Y1-ϵ1 to the toner outlet W in the longitudinal direction, when the projection portion 32Y1*c* (mounting section) that projects inward from the inner face of the toner container 32Y-ϵ are provided, failures such as accumulation of toner around the recessed portion can be alleviated.

In addition, similarly to the first embodiment, in the toner container 32Y-ϵ containing the RFID 32Y10 as the electronic data storage, the RFID 32Y10 can be effectively collected from and set again to the toner container 32Y-α during the recycle processing, and therefore, workability in the recycle processing of the toner container the toner container 32Y-α can be secured.

(Variations)

It is to be noted that, although, in first embodiment through the fifth embodiment, the toner container 32Y, 32M, 32C, and 32K contains only toner, when an image forming apparatus supplies two-component developer formed of toner and carrier, the toner container 32Y, 32M, 32C, and 32K can also contain the two-component developer. In this case, the similar effects as those in the above-described embodiments can be attained.

In addition, in the above-described embodiments, part or all of each of the image forming units 6Y, 6M, 6C, and 6K can be housed in a common unit casing and thus be formed as a process cartridge. In this case, the similar effects as those in the above-described embodiments can be attained.

In addition, with reference to FIG. 1, entire toner conveyance route formed of the toner tank 61Y, the toner conveyance path 63Y including the toner conveying screw 62Y, and the toner dropping route 64Y included in the toner supply device 60Y is И -shaped when viewed from a direction orthogonal to the surface of paper on which FIG. 1 is drawn. In addition, in FIG. 1, the toner dropping route 64Y and the downstream side of the toner conveyance path 63Y in the toner conveyance direction is provided immediately above the image forming unit 6Y (process cartridge), that is, the toner dropping route 64Y and the downstream side of the toner conveyance path 63Y are provided immediately above an attachment/detachment opening in the image forming apparatus 100 in which the image forming unit 6Y (process cartridge) is installed.

Further, the toner container 32, the toner tank 61, and the upstream side of the toner conveyance path 63 including the toner conveying screw 62 for each color are provided not the image forming section 6 for that color that above the adjacent image forming section 6 for another color (in FIG. 1, the image forming section 6 on the left). That is, for example, the toner container 32M, and a toner tank 61M and the upstream side of a toner conveyance path 63M for magenta are not positioned immediately above the image forming section 6M, but above the image forming section 6Y.

Thus, in a tandem-type image forming apparatus in which multiple image forming units are arranged in parallel, when the image forming units 6 (process cartridge) is attached to or detached from the image forming apparatus 100, the image forming units 6 and the toner supply devices 60 do not interfere with each other. Therefore, in the image forming apparatus 100, the length in the vertical direction from the toner containers 32Y, 32M, 32C, and 32K to the image forming unit 6Y, 6M, 6C, and 6K can be shortened, and as a result, the fluctuation in the amount of toner supplied to the corresponding development devices 5Y, 5M, 5C, and 5K can be prevented.

An aspect of the present invention provides a method for manufacturing a toner container. The method includes forming a cylindrical container body having a first opening in a first end thereof and a notch in a circumferential surface thereof continuous with the first opening in the first end and a second opening in an second end opposite the first end in which the first opening is formed, by rolling a rectangular shaped film into a cylinder, forming a first flange member to engage the first opening and the notch of the container body, having a toner outlet through which toner in the container body is discharged, by an injection molding, forming a second flange member to engage the second opening of the container body, by an injection molding; and attaching the first flange member and the second flange member to the container body by gluing or thermal welding.

Further, the present invention is not limited to the specifically disclosed embodiments, and variations and modifications may be made without departing from the scope of the present invention. That is, in the embodiments of the present invention, the number of elements, the positions of the corresponding elements, and the shapes of the corresponding elements are not limited to the specifically disclosed embodiments.

Numerous additional modifications and variations are possible in light of the above teachings. It is therefore to be understood that, within the scope of the appended claims, the disclosure of this patent specification may be practiced otherwise than as specifically described herein.

What is claimed is:

1. A toner container, removably installable to an image forming apparatus, the toner container comprising:

a cylindrical container body, having a first opening in a first end thereof and a notch in a circumferential surface thereof continuous with the first opening in the first end;

a flange member, to engage the first opening and the notch in the container body and having a toner outlet therein through which toner in the container body is discharged, after the toner passes through the notch;

a shutter member, disposed on the outer circumferential surface of the container body, to open and close the toner outlet, at installation of the toner container in the image forming apparatus;

a conveyance member, rotatably installed inside the container body and extending substantially along the entire inner length of the container body, to convey the toner from a second end of the container body opposite the first end in which the first opening is formed to the toner outlet in the flange member; and a recessed portion in the container body that projects inward into an interior of the toner container.

2. The toner container according to claim 1, wherein the conveyance member comprises flexible blades dimensioned so that an amount by which the blades in contact with the recessed portion deform is equal to or less than 5 mm.

3. The toner container according to claim 1, further comprising an electronic data storage storing electronic data set in the recessed portion.

4. A toner container, removably installable in an image forming apparatus, the toner container comprising:

a container body;

an electronic data storage removably attached to an outer surface of the container body a first restriction member to releasably engage the electronic data storage and restrict movement of the electronic data storage in a direction parallel to the outer surface of the toner container;

a second restriction member to releasably engage the electronic data storage and restrict movement of the electronic data storage in a direction perpendicular to the outer surface of the toner container, wherein the first restriction member comprises a boss portion protruding from the outer surface of the toner container outward, to be inserted into a hole formed in the electronic data storage, the second restriction member comprises a hook protruding from the outer surface of the toner container outward, to engage a top face of the electronic data storage, and the electronic data storage is detachable from the toner container by releasing the engagement between the electronic data storage and the hook by elastically deforming the hook.

5. A toner container, removably installable in an image forming apparatus, the toner container comprising:

a container body;

an electronic data storage removably attached to an outer surface of the container body a first restriction member to releasably engage the electronic data storage and restrict movement of the electronic data storage in a direction parallel to the outer surface of the toner container;

a second restriction member to releasably engage the electronic data storage and restrict movement of the electronic data storage in a direction perpendicular to the outer surface of the toner container, wherein the first restriction member comprises a wall that protrudes outward from the outer surface of the toner container to envelop the electronic data storage, the second restriction member comprises a lid that engages the wall and the electronic data storage and at least partially covers the top face of the electronic data storage, and the electronic data storage is detachable from the toner container by releasing the engagement between the electronic data storage and the lid after detaching the lid from the wall.

6. A toner container, removably installable in an image forming apparatus, the toner container comprising:

a container body;

an electronic data storage removably attached to an outer surface of the container body a first restriction member to releasably engage the electronic data storage and restrict movement of the electronic data storage in a direction parallel to the outer surface of the toner container; and a second restriction member to releasably engage the electronic data storage and restrict movement of the electronic data storage in a direction perpendicular to the outer surface of the toner container, wherein the first restriction member comprises a wall that protrudes outward from the outer surface of the toner container outward to envelop the electronic data storage, the second restriction member comprises a lid glued to the wall, that at least partially covers the top face of the electronic data storage, and the electronic data storage is detachable from the toner container by releasing the engagement between the electronic data storage and the lid member after detaching the lid from the wall.

7. A toner container, removably installable in an image forming apparatus, the toner container comprising:

a container body;

an electronic data storage removably attached to an outer surface of the container body a first restriction member to releasably engage the electronic data storage and restrict movement of the electronic data storage in a direction parallel to the outer surface of the toner container;

a second restriction member to releasably engage the electronic data storage and restrict movement of the electronic data storage in a direction perpendicular to the outer surface of the toner container, wherein the first restriction member and the second restriction member together form a holder to hold the electronic data storage, detachably attached to one of a recessed portion and an engagement opening formed on the outer surface of the toner container, and the electronic data storage is detachable by releasing engagement between the electronic data storage and the holder when the holder is detached from at least one the recessed portion and the engagement opening.

8. A toner container, removably installable in an image forming apparatus, the toner container comprising:

a container body;

an electronic data storage removably attached to an outer surface of the container body a first restriction member to releasably engage the electronic data storage and restrict movement of the electronic data storage in a direction parallel to the outer surface of the toner container;

a second restriction member to releasably engage the electronic data storage and restrict movement of the electronic data storage in a direction perpendicular to the outer surface of the toner container, wherein the container body is cylindrical and includes a first opening formed in a first end thereof and a notch formed in an outer circumferential surface of the container body in the first end, continuous with the first opening, the toner container further comprising:

a first flange member, to engage the first opening and the notch of the container body, having a toner outlet through which toner in the container body is discharged, after the toner passes through the notch;

a shutter member, disposed on the outer circumferential surface of the container body, to open and close the toner outlet, at installation of the toner container in the image forming apparatus;

a conveyance member, rotatably installed inside the container body and extending substantially along the entire inner length of the container body, to convey the toner from a second end of the container body opposite the first end in which the first opening is formed to the toner outlet in a longitudinal direction of the container body; and a recessed portion projecting inward from an inner face of the container body, wherein the electronic data storage is positioned in the recessed portion of the container body and close to the notch by the first restriction member and the second restriction member, and the electronic data storage, the first restriction member, and the second restriction member are arranged in a projected area of the flange member, viewed from a flange member side to the container body, when the shutter member covers the toner outlet.

9. The toner container according to claim 8, further comprising adhesive tape that fixes the first flange member to the container body, the adhesive tape at least partially covering a contact portion between the container body and the first flange member.

10. The toner container according to claim 8, wherein the container body comprises two split container halves, glued or welded together.

11. The toner container according to claim 8, wherein the container body comprises two halves, the two halves detachably joined together by a fixing member, the fixing member including a seal member, the seal member sandwiched between the two halves.

12. The toner container according to claim 11, further comprising:

a bearing to hold an end of the conveyance member opposite the first end of the container body in which the first opening is formed, the bearing having a toner inlet through which the toner is supplied into the toner container; and a seal member to a seal the toner inlet of the bearing, detachably attachable to the bearing, wherein the bearing is sandwiched and fixed between the two halves of the container when the two halves of the container are joined together.

13. The toner container according to claim 8, wherein a second opening is formed in the second end of the container body opposite the first end in which the first opening is formed, and the toner container further comprises a second flange member, fitted into the second opening in the container body, the second flange member having a bearing to hold an end of the conveyance member opposite the end in which the first opening is formed.

14. The toner container according to claim 8, wherein the conveyance member comprises a flexible blade attached to a central shaft.

15. The toner container according to claim 8, further comprising:

a toner inlet formed on an outer side of the first flange member; and a cover member detachably attachable to the first flange member to seal the toner inlet.

16. The toner container according to claim 15, wherein the first flange member further comprises a handle member provided on the outer side of the first flange member, the handle member of the first flange member including a concave portion that overlaps the toner inlet and enables the cover member to be attached and detached.

17. A toner container for use with an image forming apparatus, comprising:

a cylindrical container body having an opening at a first side thereof and a notch in a circumferential surface thereof adjacent the opening;

an end including a toner outlet and a handle, the end disposed at the opening of the container body, the toner outlet to discharge toner which passes through the notch;

a shutter, at the toner outlet, to open and close the toner outlet;

a conveyor, rotatably mounted within the cylindrical container body and extending along a length of the container body, to convey the toner towards the end from a second side of the container body, which is opposite to the first side, to the toner outlet;

a holder at an outer circumferential surface of the cylindrical container body; and an electronic data storage device at the holder.

18. The toner container according to claim 17, wherein:

the holder comprises a recessed area, and the electronic data storage device is held in the recessed area of the holder.

19. The toner container according to claim 18, wherein:

the holder comprises a flange around a top edge of the holder and extending outward in directions perpendicular to a depth direction of the recessed area of the holder.

20. The toner container according to claim 19, wherein:

the recessed area has a hollow cylindrical shape.

21. The toner container according to claim 18, wherein:

the holder is attached to and detached from the outer circumferential surface of the cylindrical container body in a direction perpendicular to the outer circumferential surface of the toner container.

22. The toner container according to claim 18, wherein:

the electronic data storage device is held at a predetermined position across a space above a bottom face of the holder.

23. The toner container according to claim 18, wherein the holder comprises:

a first restriction member that restricts movement of the electronic data storage device in a direction along the outer circumferential surface of the cylindrical container body.

24. The toner container according to claim 23, wherein the holder further comprises:

a second restriction member that restricts movement of the electronic data storage device in a direction perpendicular to the outer circumferential surface of the cylindrical container body.

25. The toner container according to claim 18, wherein:

the recessed area of the holder projects inward from an inner face of the cylindrical container body within a range from 0 mm to 5 mm.

26. The toner container according to claim 18, wherein the conveyor comprises:

a shaft; and multiple flexible blades.

27. The toner container according to claim 26, wherein:

a deformation amount by which the flexible blades of the conveyor extend into a vicinity of the recessed area is equal to or less than 5 mm.

28. The toner container according to claim 17, wherein:

the holder engages a recessed portion recessed from the outer circumferential surface of the cylindrical container body and is attached to the outer circumferential surface of the cylindrical container body.

29. The toner container according to claim 28, wherein:

the recessed portion is in a projected area of the end viewed from a longitudinal direction of the toner container.

30. The toner container according to claim 28, wherein:

a bottom of the holder that engages the recessed portion projects inward from an inner circumferential face of the cylindrical container body in a range from 0 mm to 5 mm.

31. The toner container according to claim 28, wherein the conveyor comprises:

a shaft; and multiple flexible blades.

32. The toner container according to claim 31, wherein:

a deformation amount by which the flexible blades of the conveyor extend into a bottom of the holder is set to equal to or less than 5 mm.

33. The toner container according to claim 17, wherein:

the holder engages an engagement opening that is open at the outer circumferential surface of the cylindrical container body and is attached to the outer circumferential surface of the cylindrical container body.

34. The toner container according to claim 33, wherein:

the engagement opening is at a projected area of the end viewed from a longitudinal direction of the toner container.

35. The toner container according to claim 33, wherein:

a bottom of the holder that engages the engagement opening projects inward from an inner circumferential face of the cylindrical container body in a range from 0 mm to 5 mm.

36. The toner container according to claim 33, wherein the conveyor comprises:

a shaft; and multiple flexible blades.

37. The toner container according to claim 36, wherein a deformation amount by which the flexible blades of the conveyor extend into a bottom of the holder is equal to or less than 5 mm.

38. A toner container for use with an image forming apparatus, comprising:

a container body;

an electronic data storage device at an outer surface of the container body;

a first restriction member to releasably engage the electronic data storage device and restrict movement of the electronic data storage device in a direction parallel to the outer surface of the toner container proximate to the electronic data storage device;

a second restriction member to releasably engage the electronic data storage device and restrict movement of the electronic data storage device in a direction perpendicular to the outer surface of the toner container; and a holder which includes the first restriction member, the holder to hold the electronic data storage device, set in the outer surface of the container body, the holder engaging a recessed portion of outer surface of the container body, and the electronic data storage device becomes detachable when an engagement between the holder and the recessed portion is released.

39. The toner container according to claim 38, wherein the holder further includes:

the second restriction member.

40. A toner container for use with an image forming apparatus, comprising:

a container body;

an electronic data storage device at an outer surface of the container body;

a first restriction member to releasably engage the electronic data storage device and restrict movement of the electronic data storage device in a direction parallel to the outer surface of the toner container proximate to the electronic data storage device;

a second restriction member to releasably engage the electronic data storage device and restrict movement of the electronic data storage device in a direction perpendicular to the outer surface of the toner container; and a holder which includes the first restriction member, the holder to hold the electronic data storage device, set in the outer surface of the container body, the holder engages an engagement opening in the outer circumferential surface of the cylindrical container body, and the electronic data storage device becomes detachable when the engagement between the holder and the engagement opening is released.

41. The toner container according to claim 40, wherein the holder further includes:

the second restriction member.

* * * * *